US012247802B2

(12) United States Patent
Du Plessis

(10) Patent No.: US 12,247,802 B2
(45) Date of Patent: Mar. 11, 2025

(54) VALVE ASSEMBLY FOR A PRE-CHARGED PNEUMATIC AIRGUN

(71) Applicant: Hendrik Frederik Du Plessis, Pretoria (ZA)

(72) Inventor: Hendrik Frederik Du Plessis, Pretoria (ZA)

( * ) Notice: Subject to any disclaimer, the term of this patent is extended or adjusted under 35 U.S.C. 154(b) by 0 days.

(21) Appl. No.: 18/547,835

(22) PCT Filed: Feb. 25, 2022

(86) PCT No.: PCT/IB2022/051667

§ 371 (c)(1),
(2) Date: Aug. 24, 2023

(87) PCT Pub. No.: WO2022/180583

PCT Pub. Date: Sep. 1, 2022

(65) Prior Publication Data

US 2024/0302129 A1 Sep. 12, 2024

(30) Foreign Application Priority Data

Feb. 25, 2021 (ZA) ..... 2021/01261

(51) Int. Cl.
*F41B 11/723* (2013.01)

(52) U.S. Cl.
CPC ..... *F41B 11/723* (2013.01)

(58) Field of Classification Search
CPC ..... F41B 11/723
(Continued)

(56) References Cited

U.S. PATENT DOCUMENTS 4,699,351 A * 10/1987 Wells ..... F16K 31/408 251/38
6,601,780 B1 * 8/2003 Sheng ..... F41B 11/71 124/66

(Continued)

FOREIGN PATENT DOCUMENTS

RU 2708467 C1 12/2019

OTHER PUBLICATIONS

International Search Report dated May 10, 2022, for PCT/IB2022/051667, 7 pp.

(Continued)

*Primary Examiner* — Samir Abdosh
(74) *Attorney, Agent, or Firm* — NIXON & VANDERHYE P.C.

(57) ABSTRACT

The invention provides a valve assembly (10) suitable for, although not limited to, use in a Pre-Charged Pneumatic airgun which includes a barrel (12), a plenum (14), and a trigger mechanism. The valve assembly (10) comprises a valve (16) including a valve body (18) terminating at one end in a valve face (20) and at an opposite end in a valve base (22); an end cap (26) located at one end of the valve (16) such that the valve (16) is slidingly displaceable relative to the end cap (26); a pressure chamber (28) defined between the valve base (22) and the end cap (26); an air flow channel (24) extending between the plenum (14) and the pressure chamber (28) for guiding pressurized air from the plenum (14) to the valve base (22); and a velocity-adjustment screw (30) located in the air flow channel (24) for adjusting air flow from the plenum (14) to the pressure chamber (28).

28 Claims, 13 Drawing Sheets

Figure 7:
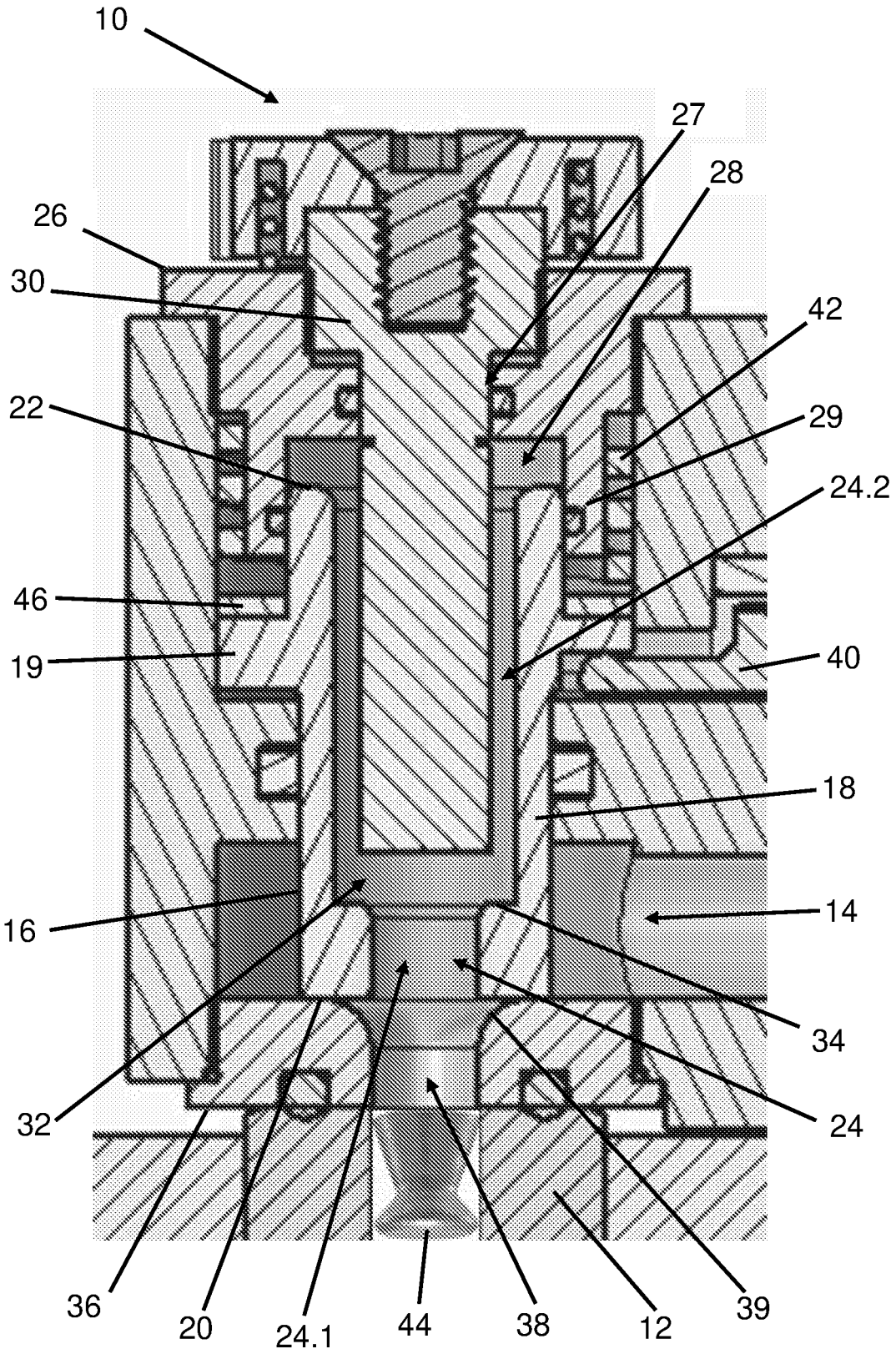

(58) Field of Classification Search
USPC ..... 124/73
See application file for complete search history.

(56) References Cited

U.S. PATENT DOCUMENTS

| | | | | |
|---|---|---|---|---|
| 2003/0168052 | A1* | 9/2003 | Masse | F41B 11/57 124/73 |
| 2007/0272222 | A1* | 11/2007 | Ho | F41B 11/723 124/73 |
| 2017/0211906 | A1* | 7/2017 | Colby | F41B 11/723 |
| 2019/0293383 | A1* | 9/2019 | Skilling | F41B 11/723 |
| 2024/0271904 | A1* | 8/2024 | Trendall | F41F 1/00 |

OTHER PUBLICATIONS

Written Opinion of the ISA dated May 10, 2022, for PCT/IB2022/051667, 10 pp.

* cited by examiner

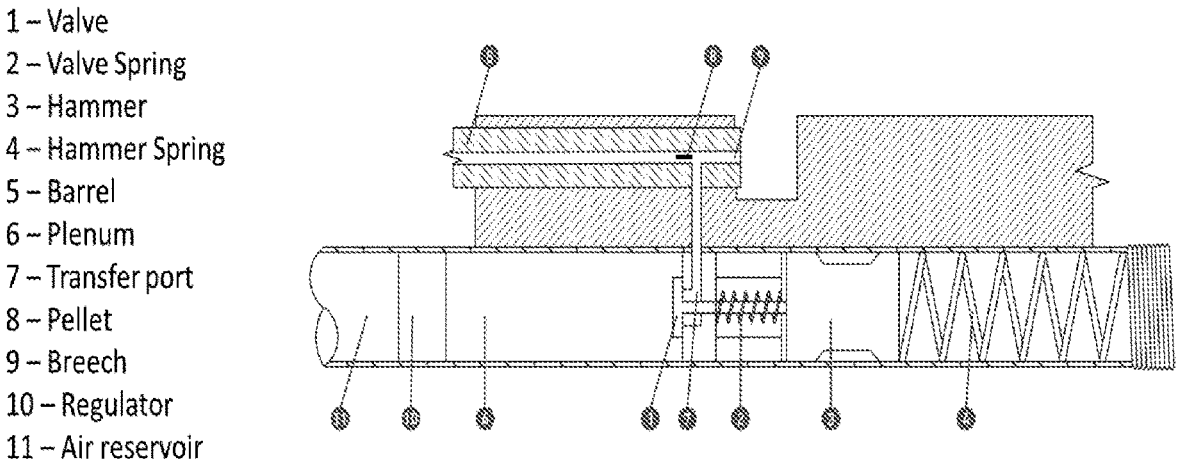
FIGURE 1 (PRIOR ART): Basic PCP air gun
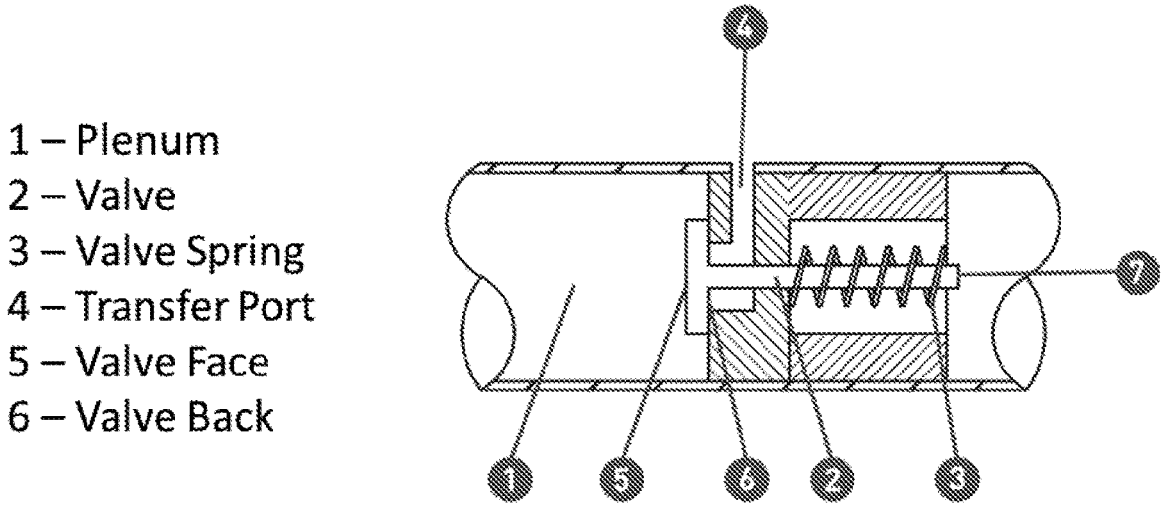
FIGURE 2 (PRIOR ART): Poppet valve

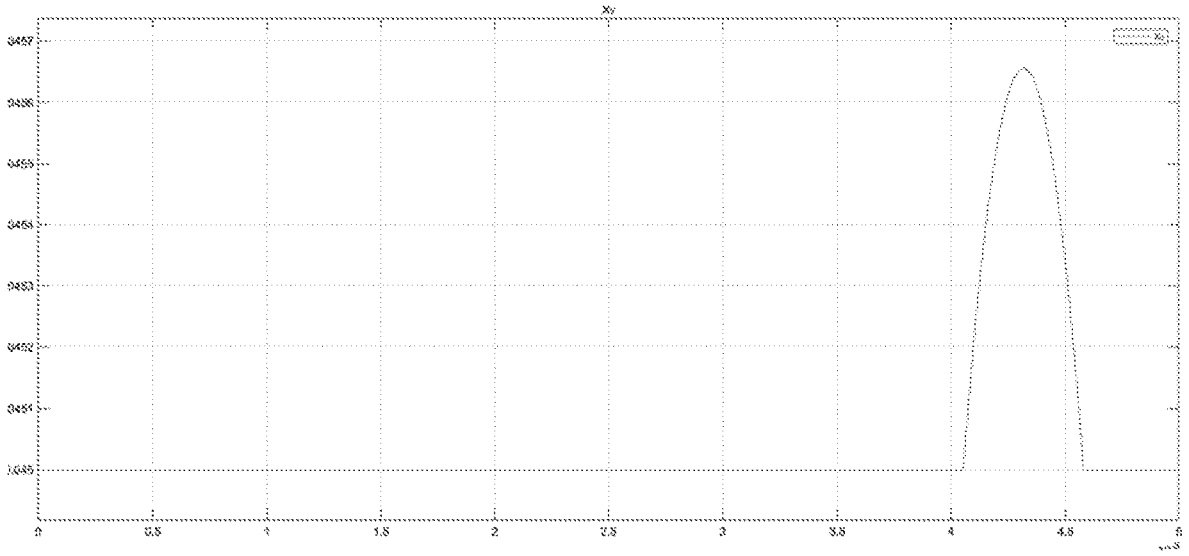
FIGURE 3 (PRIOR ART): Poppet valve lift-and-dwell as a function of time
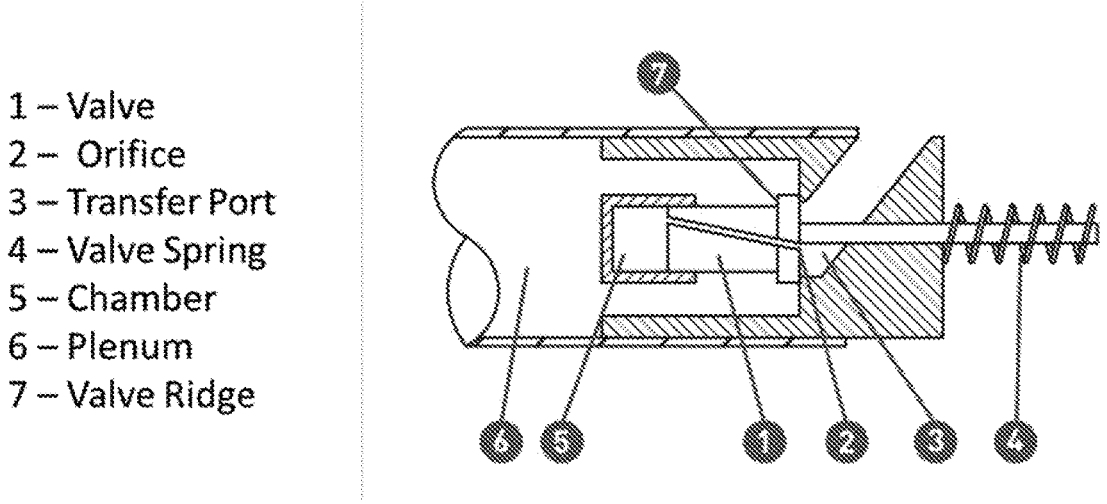
FIGURE 4 (PRIOR ART): Balanced poppet valve

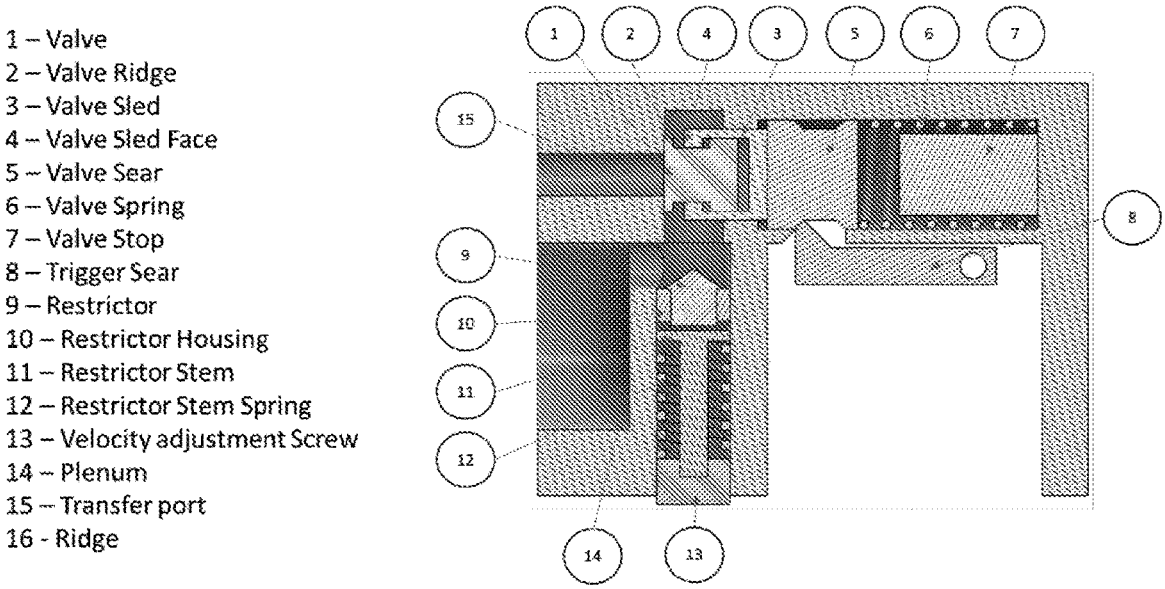
FIGURE 5 (PRIOR ART): Huben valve
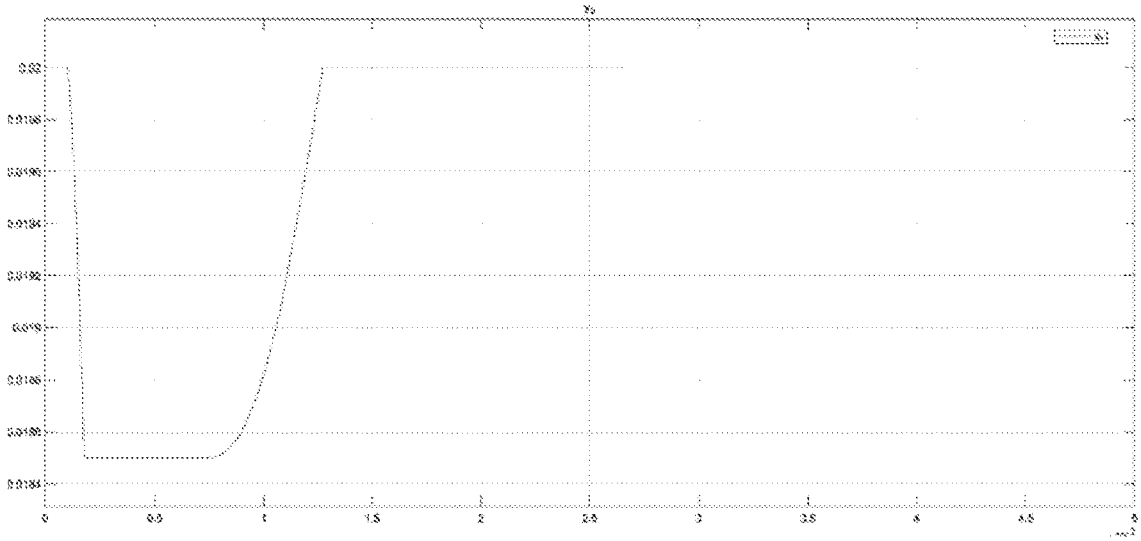
FIGURE 6 (PRIOR ART): Huben valve movement

For a small velocity-adjustment gap, the valve dwell time is longer:
the valve stays open for 1,4 mS For a large velocity-adjustment gap, the valve dwell time is shorter:
the valve stays open for 0,55 mS

VALVE ASSEMBLY FOR A PRE-CHARGED PNEUMATIC AIRGUN

CROSS-REFERENCE TO RELATED APPLICATIONS

This application is the U.S. national phase of International Application No. PCT/IB2022/051667 filed Feb. 25, 2022 which designated the U.S. and claims priority to ZA 2021/01261 filed Feb. 25, 2021, the entire contents of each of which are hereby incorporated by reference.

INTRODUCTION

This invention relates to a valve assembly suitable for, although not limited to, use in a Pre-Charged Pneumatic (PCP) airgun that will allow a wide range of pellet velocities for a single pressure setting in a plenum, and where valve lift-and-dwell time is not dictated by hammer weight or hammer spring tension.

BACKGROUND TO THE INVENTION

Airguns, or more generally, gas guns, extract energy from a compressed gas to propel a pellet. There are two basic architectures to build an airgun:

(i) A spring piston airgun relies on a compressed metallic or pneumatic spring which, when the gun is fired, compresses the air that drives a pellet down a barrel.

(ii) The other fundamental architecture uses a high-pressure reservoir as a source of high-pressure air. In small, portable airguns, the reservoir is part of the gun. In large airguns, the reservoir can be separate from the gun itself.

Small PCP (Pre-Charged Pneumatic) airguns have become extremely popular in the last few years, with their internals having evolved to a high degree of sophistication and their accuracy rivalling that of high-quality conventional firearms. Historically, PCP airguns have been around for a long time and, while their most common application is in sport shooting (e.g., all modern Olympic air rifles are of the PCP-type), their concept also found application in warfare and hypervelocity research. In the late 1800's, for example, the city of San Francisco (USA) was defended by a battery of PCP air cannon, capable of launching 500 lb. pellets over a mile out to sea, and PCP mortars were used during WWI.

While modern artillery displaced PCP artillery long ago, sophisticated variations on gas guns are used today to simulate the effects of micro-meteorite impacts, where extremely high velocities must be achieved. In addition, paintball guns and airsoft guns also use compressed air, among others, as propellant, although the valve design of these types of guns tend to be hugely different than those used in PCP airguns due to much lower velocities of the projectiles. This patent application deals specifically with PCP airguns that shoot pellets or slugs for target or hunting purposes.

Basic Operation of a PCP Air Gun—FIG. 1 (Prior Art)

FIG. 1 (Prior Art) shows the basic components of a PCP airgun with a "knock down" or "poppet" valve. Most PCP's currently in the market utilize the poppet valve or variations thereof.

The firing cycle of a standard PCP airgun begins when a trigger sear releases a hammer (3), which is held against a compressed spring (4). The hammer (3) accelerates under the force of the spring (4) and, after travelling a short distance, it strikes a valve (1) that communicates with a plenum (6) (i.e., high-pressure air source), which is either regulated or unregulated (as discussed below). Upon being struck by the hammer (3), the valve (1) briefly opens, allowing a blast of high-pressure air to be routed to a transfer port (7) and from there to a breech (9), where pressure builds up and propels a pellet/slug (8) down a barrel (5).

Velocity of the pellet/slug (8), and hence power of the gun, depends on several factors:

Air pressure in the plenum (6)
Volume of the plenum (6)
Length and diameter (i.e., volume) of the transfer port (7)
Time the valve (1) remains open
Length of the barrel (5)
Weight of the pellet/slug (8)

In general, for an unregulated gun, a user can only adjust the power of the gun by increasing the time the valve (1) remains open, because all the other variables, apart from pellet/slug weight, are fixed during the design process. For a regulated gun, power can be adjusted by either increasing pressure in the plenum (6) through a regulator (10), and/or by increasing the time the valve (1) remains open. There are, however, guns that also allow the user to change the size of the transfer port (7), and hence the volume of air that can be expelled during the firing cycle.

Regulated Vs Unregulated

In an unregulated PCP airgun, there is no regulator (10) present, and the valve (1) is directly connected to a high-pressure reservoir (11). With each shot, pressure in the reservoir (11) decreases slightly. However, the valve (1) opens slightly more with each successive shot, because the closing force on the valve (1) is reduced by reducing pressure in the reservoir (11), while the impact of the hammer (3) on the valve (1) remains constant. The result is a "power curve", where the velocity of the pellet/slug (8) differs slightly from shot to shot.

In a regulated PCP airgun, a regulator (10) is installed between the high-pressure reservoir (11) and the plenum (6), reducing the pressure to a constant pressure in the plenum (6). The result is a consistent and repeatable movement of the valve (1) as forces acting on the valve (1) during a firing cycle remain consistent from one shot to the next, resulting in a consistent pellet/slug velocity from shot to shot.

Due to the above, high quality airguns are nearly always of the regulated kind as a consistent pellet/slug velocity from shot to shot greatly affect accuracy.

Poppet Valve (FIG. 2—Prior Art)

FIG. 2 (Prior Art) illustrates an enlarged view of a poppet valve (2), such as the one illustrated in FIG. 1 (Prior Art). The valve (2) is maintained in a closed position by air pressure in the plenum (1), pushing against the valve head (5), and to a lesser degree by the valve spring (3). When a hammer strikes the stem (7) of the poppet valve (2), the impact required to displace the valve (2) is very high due to the high force exerted on the valve head (5) by compressed air in the plenum (1). Once the valve (2) opens, air flows into the transfer port (4), and pressure in the plenum (1) equalizes quickly with that in the transfer port (4), while forces across the valve face (5) and valve back (6) cancel each other to a large degree. The remaining force is equal to the pressure in the plenum (1), times the area of the valve stem (7), plus the force exerted by the valve spring (3), which slows the valve (2) to a stop, reverses the valve direction, and closes the valve (2), all within 1 to 2 milliseconds. However, when the hammer (3) strikes the valve stem (7), it will bounce back and might strike the valve stem (7) again, while the valve (2) is open, under the force of the hammer spring (4) (i.e., referred to as "hammer bounce"). This second or third strike of the hammer (3) prevents the valve (2) from closing quickly and air is wasted. Further, depending on the design of the valve (2), the valve can bounce when it contacts the valve seat. Each bounce releases additional short bursts of air into the transfer port (4) and barrel, which can upset the pellet/slug and increase the use of air, reducing the valve's efficiency.

As mentioned previously, and with reference to FIG. 1 (Prior Art), velocity of a pellet/slug (8), and hence power of the gun, can be adjusted by increasing the duration the valve (1) remains open. This is achieved by increasing tension on the hammer spring (4), which increases hammer velocity, resulting in increased impact between the hammer (3) and the valve (1). As the impact increases, valve lift-and-dwell time increases, resulting in more air being released from the plenum (6) and hence greater pellet/slug (8) velocity. In general valve lift is defined by the hammer velocity, and valve dwell by the mass of the hammer (3).

FIG. 3 (Prior Art) plots valve lift-and-dwell as a function of time. The valve (1) reaches its maximum lift, comes to a standstill, dwells, and then starts closing, resulting in a triangularly-shaped graph. The energy which is released from the reservoir (11) and which is available to accelerate the pellet/slug (8), is the area below the graph. It is therefore obvious that to increase the amount of air (energy) released from the plenum (6), it is required either to increase valve lift, increase the duration the valve remains open (dwell), or open-and-close the valve faster. A valve producing a square curve would be almost double as efficient as a valve producing a triangular curve. This applies if valve lift is not greater than % of the valve orifice diameter.

Also note that, in this graph the valve only starts opening at 4 mS after the trigger is released, although those skilled in art will appreciate that, depending on gun design, the valve can start opening at any time between approximately 3 mS and 6 mS. This accounts for the time it takes the hammer (3) to move from its initial resting position to the moment when it hits the valve stem (7) under force of the hammer spring (4).

For small calibres (e.g., 0.177) and low powered rifles (e.g., 7-foot pounds), such as those used in 10 m Olympic competitions, the current state of the art is more than enough. However, for larger calibres (up to 0.45) and more powerful airguns (e.g., 150-foot pounds or more), the amount of energy that must be released for each shot requires higher plenum pressures (up to 200 bar) and higher valve lift-and-dwell times. To achieve these increased lift-and-dwell times against extremely high pressure, the mass of the hammer (3), as well as the force in the spring (4), needs to increase, leading to airguns that are difficult to cock and operate. This has led to the development of so-called "balanced poppet" valves.

Balanced Poppet Valves—FIG. 4 (Prior Art)

FIG. 4 (Prior Art) illustrates a balanced poppet valve (1), which is being held in a closed position by tension of the valve spring (4) and high air pressure in the plenum (6) acting on the valve ridge (7). Since the area of the valve ridge (7) is much less than that of the poppet valve (2) shown in FIG. 2 (Prior Art), the air pressure force holding the valve closed is orders of magnitude less than that shown in FIG. 2 (Prior Art) for the same plenum pressure. Therefore, the impact necessary from a hammer to achieve the required lift-and-dwell is greatly reduced, so a smaller hammer and lighter spring can be used.

The chamber (5) behind the valve (1) is connected via a small orifice (2) to the transfer port (3). When the hammer strikes the valve (1), the valve lifts from its seat and a blast of high-pressure air is allowed into the transfer port (3). The transfer port (3) pressurizes, and a small amount of air is forced back through the orifice (2) into the chamber (5), rapidly equalizing pressure at the back of the valve (1) to that in the plenum (6) and transfer port (3). As a result, the valve (1) closes as if it were a normal poppet valve.

Timing of the valve (1) follows the same curve as that in FIG. 3 (Prior Art), but it is much easier to achieve high lift-and-dwell times with a light spring and hammer. In both the poppet valve and balanced poppet valves, the time the valve remains open is dictated by the hammer weight and the hammer spring tension.

Solenoid Valves

Advent of the digital age has led to the development of electronic airguns. Electronic airguns replace the conventional hammer-and-spring arrangement with powerful solenoid and control electronics. However, the valve is still either a conventional poppet valve or a balanced poppet valve.

When a trigger is actuated, a solenoid pushes the valve against the high pressure in the plenum, forcing it open. It holds it open against the opposing forces for a short time and then the solenoid pulls the valve close. This results in a very predictable valve movement and the valve curve is nearly square, resulting in a very efficient release of air from the plenum. The control electronics allow for real-time measurement of pressure and temperature in different parts of the gun and adjust the valve lift-and-dwell automatically to achieve the desired pellet/slug velocity.

However, electronic guns are much more expensive than their mechanical counterparts. Also, use is dependent on the state of the batteries.

The Huben Valve—FIG. 5 (Prior Art)

The Huben Valve, which is illustrated in FIG. 5 and which is referred to herein as the "Huben Valve" after the company that produces the Huben K1 air rifle that includes this valve, made its appearance in 2017. The valve differs from previous valves in that it is a hammerless, self-opening valve. The valve (1) is pressed against a valve seat by a pneumatic force from the plenum (14) applied to a valve ridge (2). A secondary pneumatic force is applied to a valve sled (3) against a valve sled face (4). The valve (1) can move freely within the valve sled (3). This freedom of movement allows the pneumatic force in the plenum (14) to push the valve (1) against the valve seat and maintain the valve (1) in the closed position. Since the area of the valve sled face (4) is greater than that of the valve ridge (2), there is a net force in the direction of a valve sear (5), with the net force being opposed by a trigger sear (8).

When the trigger sear (8) is displaced by a trigger mechanism, the valve sled (3) and the valve sear (5) are displaced in the direction of a valve stop (7) by the pneumatic force acting on the valve sled face (4), dragging the valve (1) along with it and opening the transfer port (15) to let a blast of air into the gun breech. Movement of the valve (1), valve sled (3), and valve sear (5) is controlled by a valve spring (6) until the valve (1), valve sled (3), and valve sear (5) come to rest against the valve stop (7). The valve has effectively been "blown open". Since there is no pneumatic force acting on the back of the valve (1), as is the case with the poppet valve, the valve (1) only closes once pressure in the plenum (14) falls below the force being applied by the spring (6). Since the spring (6) is relatively light, the pressure drop that is required to close the valve (1) is high, so a large volume of air escapes the plenum (14). This makes the gun inefficient and impractical.

To control closing of the valve (1), a secondary mechanism—a restrictor (9, 10, 11, 12, 13)—is placed inside the plenum (14). When pressure inside the plenum (14) drops as the valve (1) is opened, a restrictor stem (11) moves upward under tension of a restrictor stem spring (12) until it touches the base of the restrictor (9). The restrictor stem (11) lifts the restrictor (9) from its seat, pushing it towards a ridge such that it cuts off air flow to the transfer port (15). This causes a rapid loss of pressure in a top half of the plenum (14), which allows the spring (6) to close the valve (1) and the firing cycle is complete. The restrictor (9) has a small groove cut onto its face, which allows air from a bottom half of the plenum (14) to flow to a top half of the plenum (14), increasing pressure in the top half. This increasing pressure pushes the valve (1) against the valve seat, pushes the valve sled (3) in the direction of the valve stop (7) until the valve sear (5) engages the trigger sear (8), and pushes the restrictor (9) down against the restrictor stem spring (12). The gun is now ready to fire again.

Pellet/slug velocity and power of the gun is adjusted by adjusting tension in the restrictor stem spring (12) by means of a velocity-adjustment screw (13). The higher the tension, the less the pressure drop required and the shorter the time required for the restrictor (9) to move upwards, resulting in a low power shot. The weaker the tension, the higher the pressure drop required and the longer the restrictor (9) will take to move upwards, resulting in a more powerful shot. It follows that valve timing (i.e., the duration of time the valve is open) is not dependent on the weight of a hammer, nor tension in a hammer spring. The resultant valve movement is shown in FIG. 6 (Prior Art). The valve (1) opens extremely fast but closes slowly due to the pneumatic force during opening being much greater than the spring force during closing. However, the graph curve is "squarer", indicating that the volume of air, and hence energy, that is released during a unit time is greatly increased in comparison to the poppet valve or balanced poppet valve, which increases valve efficiency significantly. The result is a very powerful gun—in fact, the gun in .22 calibre delivers nearly 90-foot pounds of energy.

It is an object of the present invention to produce a valve assembly, particularly suitable for a PCP airgun, that aims to increase efficiency of the gun; reduce lock time (defined herein as the time from when the trigger releases the sear until a pellet/slug leaves the barrel); reduce recoil, especially in larger calibres; allow a wide range of pellet/slug velocities for a single pressure setting in the plenum; eliminate, or at least reduce, hammer bounce and valve bounce; and where valve lift-and-dwell time is not dictated by hammer weight or hammer spring tension.

SUMMARY OF THE INVENTION

According to the invention there is provided a valve assembly suitable for, although not limited to, use in a Pre-Charged Pneumatic (PCP) airgun which includes a barrel, a plenum, and a trigger mechanism, the valve assembly comprising—

- a valve including a valve body terminating at one end in a valve face and at an opposite end in a valve base;
- an end cap located at one end of the valve such that the valve is slidingly displaceable relative to the end cap;
- a pressure chamber defined between the valve base and the end cap;
- an air flow channel extending between the plenum and the pressure chamber for guiding pressurized air from the plenum to the valve base; and
- a velocity-adjustment screw located in the air flow channel for adjusting air flow from the plenum to the pressure chamber;
- the arrangement being such that valve lift is fixed through displacement of the valve body, while valve dwell time is controlled by choking airflow into the pressure chamber through adjustment of the velocity-adjustment screw.

The valve may be displaceable between a closed position, in which it closes air flow from the plenum to the barrel; and an open position in which air flow from the plenum is forced through the barrel to eject a pellet/slug, while simultaneously air flow from the plenum flows through the air flow channel into the pressure chamber to push against the valve base, thus forcing the valve to the closed position, wherein air flow rate into the pressure chamber is manipulated by the velocity-adjustment screw.

In a first embodiment of the invention, the air flow channel may extend through and be coaxially aligned with the valve body. In this embodiment, the velocity-adjustment screw may extend through the end cap, be coaxially aligned with the valve, and extend partially into the air flow channel to create a velocity-adjustment gap between the valve body and the velocity-adjustment screw.

The size of the velocity-adjustment gap may be adjusted by adjusting the velocity-adjustment screw relative to the valve body. It will be appreciated that the velocity-adjustment gap decreases when the valve moves from a closed to an open position; and increases when the valve moves from an open to a closed position, thereby increasing airflow into the pressure chamber, resulting in an increased pneumatic force acting on the valve base.

The valve body may include a stepped internal wall which defines a first air flow channel of smaller diameter with an opening that opens into the plenum when the valve is in the open position; and a neighbouring, coaxial second air flow channel of larger diameter with an opening that opens into the pressure chamber, such that the plenum is arranged in air flow communication with the pressure chamber; with a substantially rectangular step being defined between the first and second air flow channels. The velocity-adjustment screw may be positioned within the air flow channel such that the velocity-adjustment gap is defined between an end of the velocity-adjustment screw and the rectangular step in the stepped internal wall of the valve body.

The end cap may include an aperture which protrudes through the end cap in co-axial alignment with the air flow channel through which the velocity-adjustment screw protrudes. The end cap may include an end cap cylinder extending from one end of the end cap and within which the valve is slidingly displaceable.

The valve assembly further may include a valve seat located intermediate, and coaxially aligned with, the valve and the barrel against which the valve face seals when the valve is in a closed position. In this embodiment, the valve seat may include a short, large diameter transfer port extending through the valve seat. The transfer port may be curved radially outwardly towards the direction of the valve face.

In an alternative embodiment of the invention, the valve may linearly be offset to the barrel.

The valve assembly may include a trigger-actuated valve lever which mechanically cooperates with the valve for displacing the valve from a closed to an open position. The valve assembly also may include a valve return spring for assisting displacement of the valve from an open to a closed position.

In one form of the invention, no air pressure from the plenum is exerted on the valve to seal the valve in the closed position, but instead the valve is sealed in the closed position under pressure only of the valve return spring, which is orders of magnitude less than that of air pressure in the plenum. In this embodiment, the valve lever acts directly on the valve to displace the valve from the closed to the open position. Also, in this embodiment the valve may include a valve wing extending radially outwardly from the valve and configured to come to rest against the end cap cylinder of the end cap when the valve is fully open.

In an alternative form of the invention, the valve assembly includes a sled within which the valve is arranged coaxially such that the valve is linearly displaceable with, and slightly relative to, the sled. The sled includes a hollow body terminating at one end in a sled face and at an opposite end in a sled base; and a sled wing extending radially outwardly from the hollow body and configured to come to rest against the end cap cylinder of the end cap when the valve is fully open. The sled is coaxially aligned with the end cap and slidingly displaceable, together with the valve, in the end cap cylinder, such that the pressure chamber is defined between the sled base, the valve base, and the end cap.

The sled body defines a substantially cylindrical, stepped internal wall which creates a sled neck of smaller diameter and a sled skirt of larger diameter, with a sled step being defined between the sled neck and sled skirt. The complimentarily configured valve sequentially includes a valve ridge of a first diameter, a valve neck of a second, smaller diameter, and a valve skirt of a third, larger diameter, with a valve step being defined between the valve neck and valve skirt. The valve is located within the sled such that a small gap is defined between the sled step and the valve step to allow linear displacement of the valve relatively to the sled.

In this alternative form of the invention, air pressure from the plenum is exerted on the valve ridge to force the valve into the closed position, while simultaneously air pressure from the plenum is exerted on the sled face, creating a net force in the direction of the end cap. The valve lever acts on the sled to restrain displacement of the sled from the closed to the open position.

Once the valve lever is released, air pressure from the plenum pushes the sled in the direction of the end cap. Once the sled step engages the valve step, the sled pulls the valve to the open position. Air pressure from the plenum enters the barrel to eject a pellet/slug, while simultaneously air flows from the plenum through the air flow channel into the pressure chamber to push against the valve base and the sled base, thus forcing the sled and the valve to the closed position, the arrangement being such that the mass flow rate of air that enters the pressure chamber is determined by the size of the velocity-adjustment gap when the valve is in a fully open position. When the plenum is not pressurized, the valve is held in the closed position by forward pressure from the return spring.

In a second embodiment of the invention the air flow channel may extend between the transfer port and the pressure chamber, circumventing the valve. In this embodiment, the valve assembly may include a valve seat which divides the plenum into two plenum compartments, the valve seat including a valve seat passage extending through the valve seat for linking the two plenum compartments; and a transfer port passage linking one of the plenum compartments with the transfer port. In this embodiment, the valve may linearly be offset to the barrel, with the transfer port passage being coaxially aligned with the valve, but angularly offset to the transfer port; and the transfer port being angularly offset to the barrel.

SPECIFIC EMBODIMENTS OF THE INVENTION

The invention will now further be described and illustrated with reference to the accompanying drawings in which FIGS. 1 to 18 illustrate the following—

Figure 8:
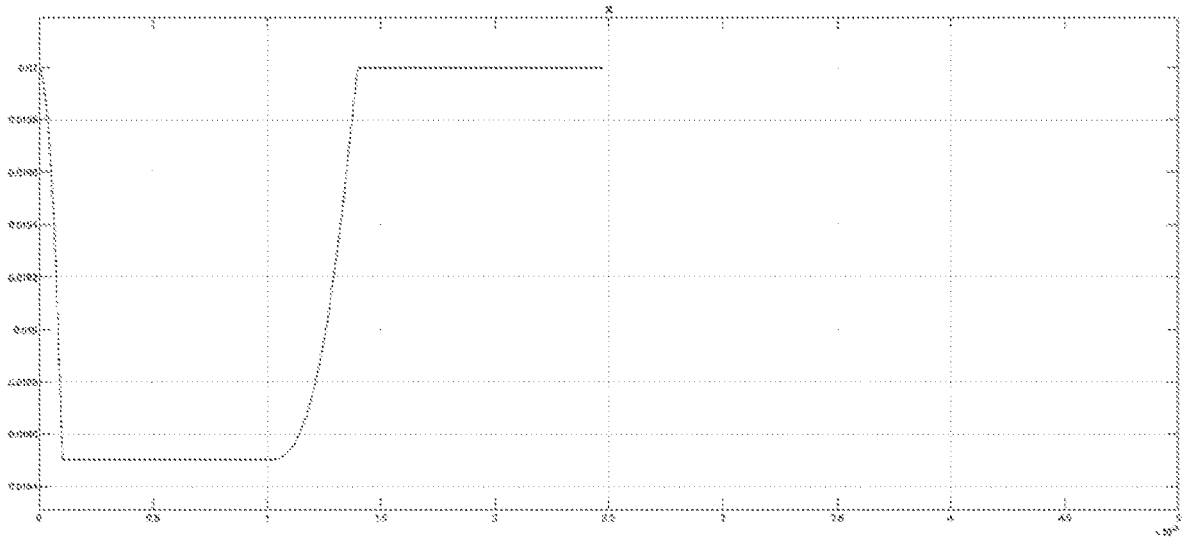
Figure 9:
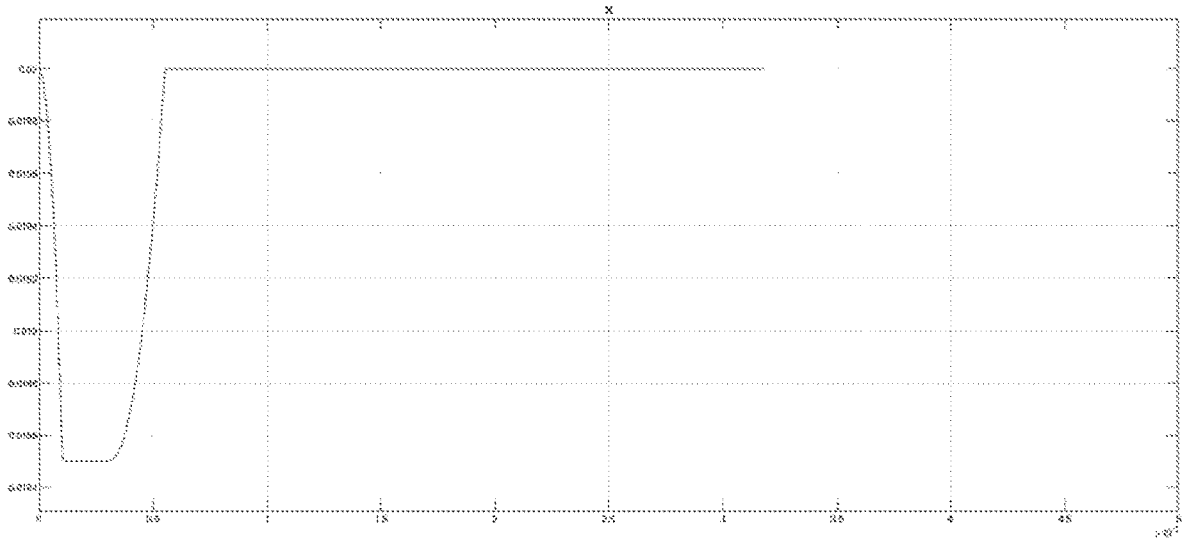
Figure 10:
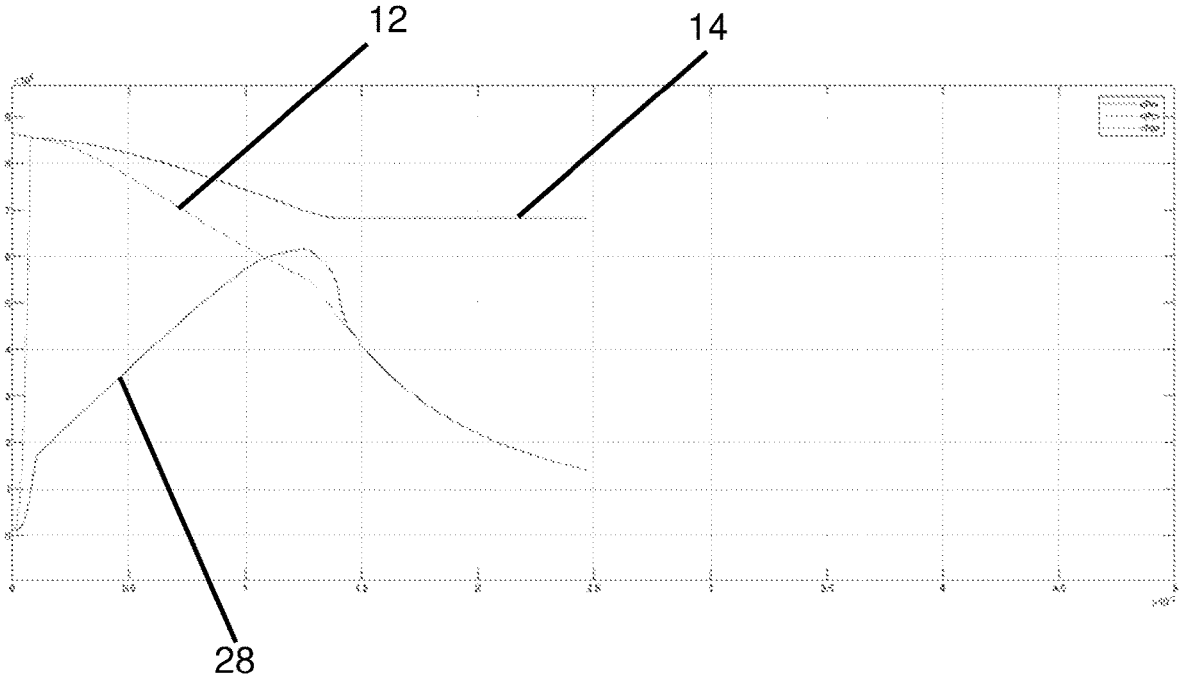
Figure 11:
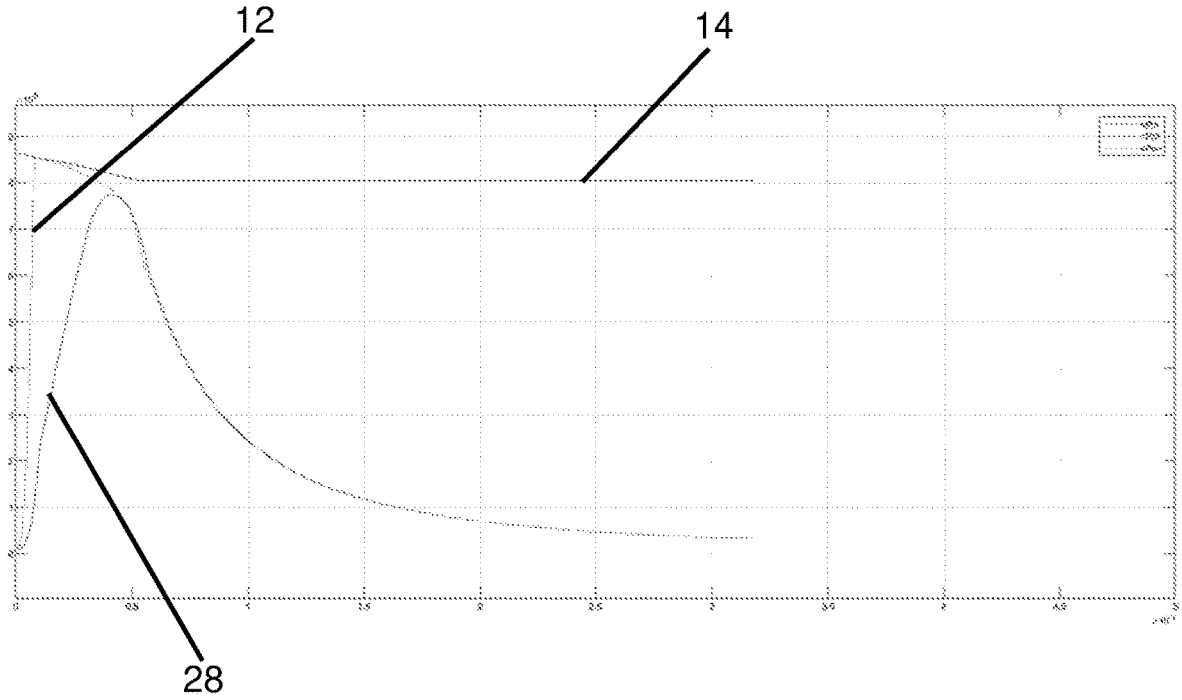
Figure 12:
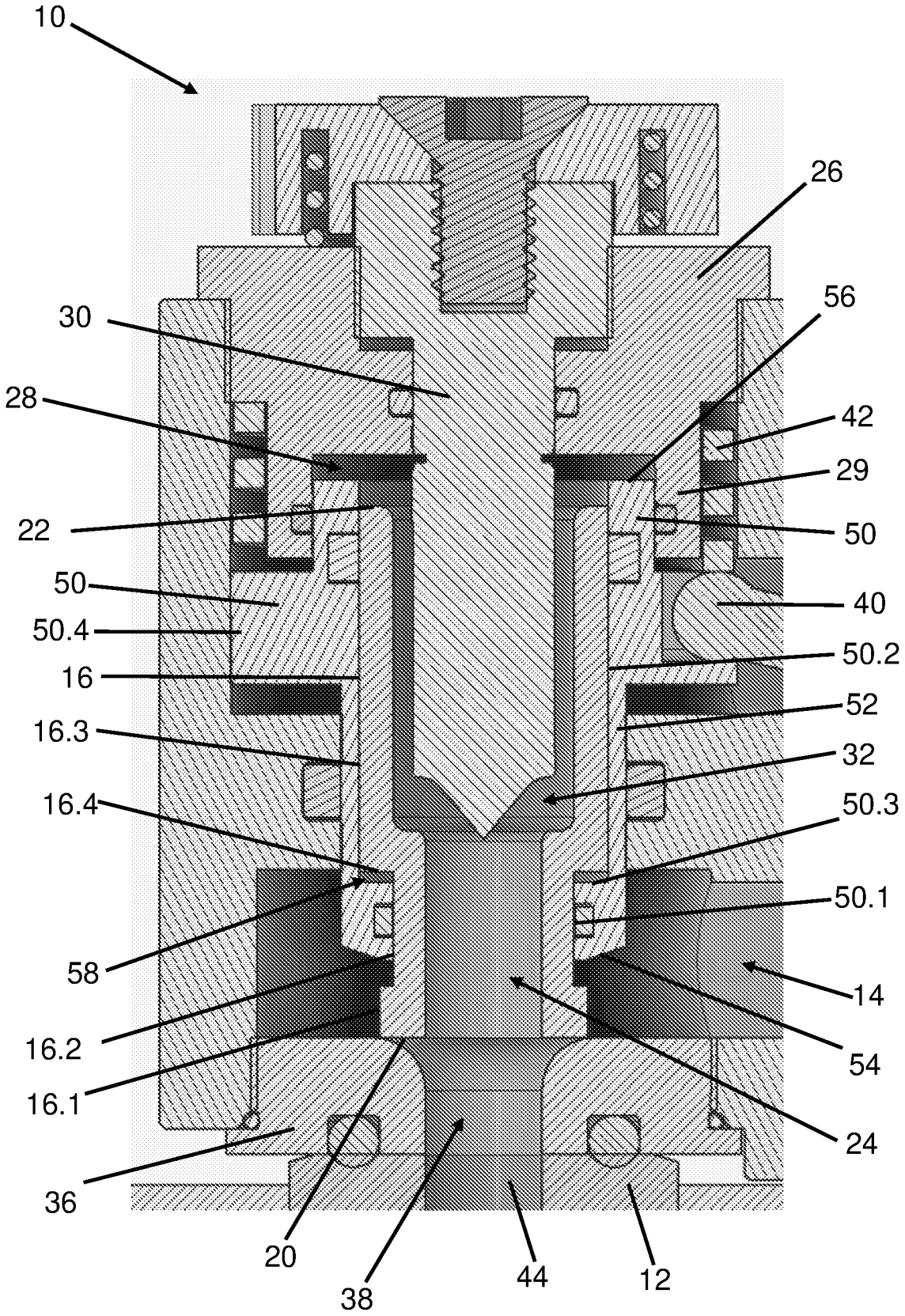
Figure 13:
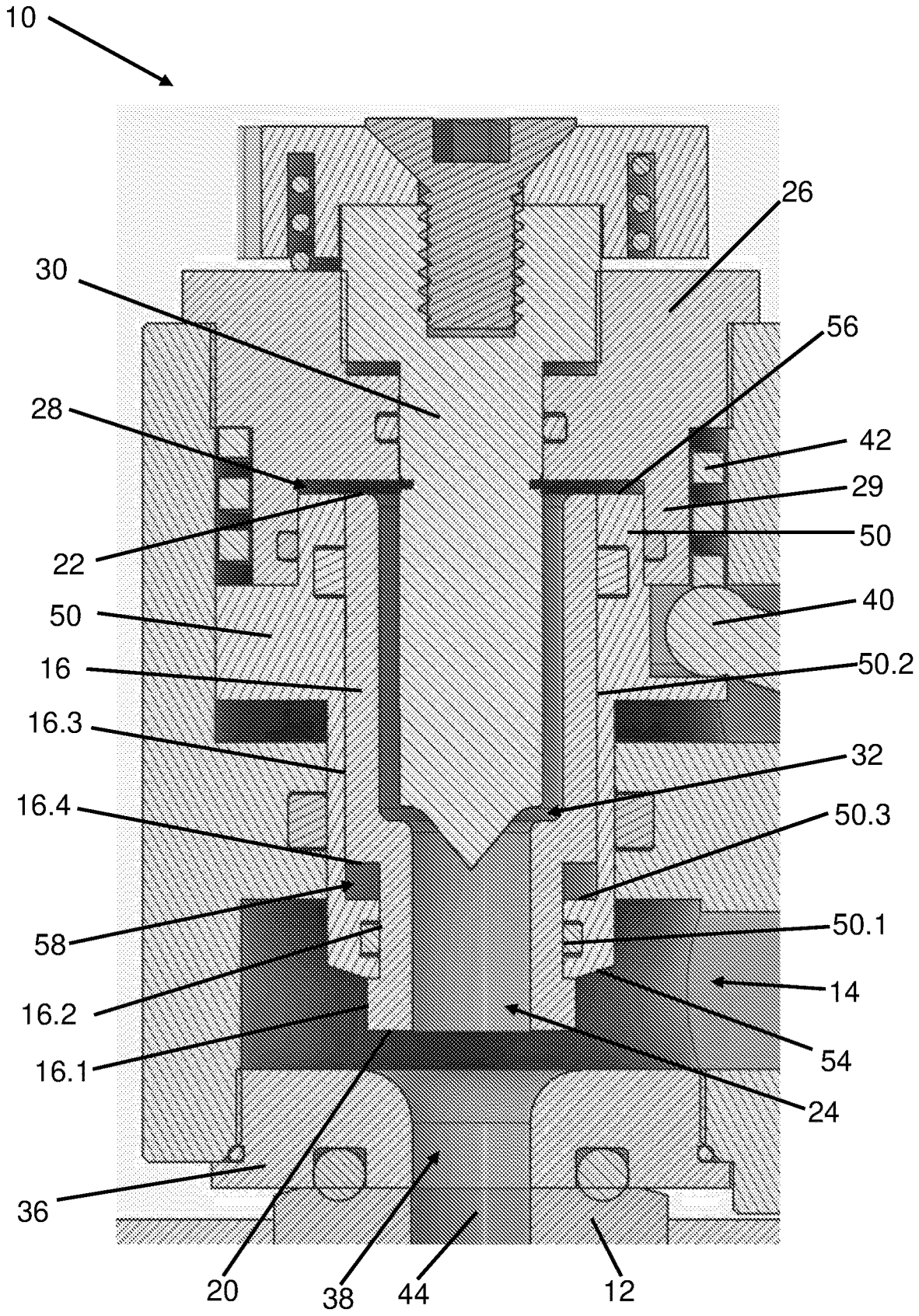
Figure 14:
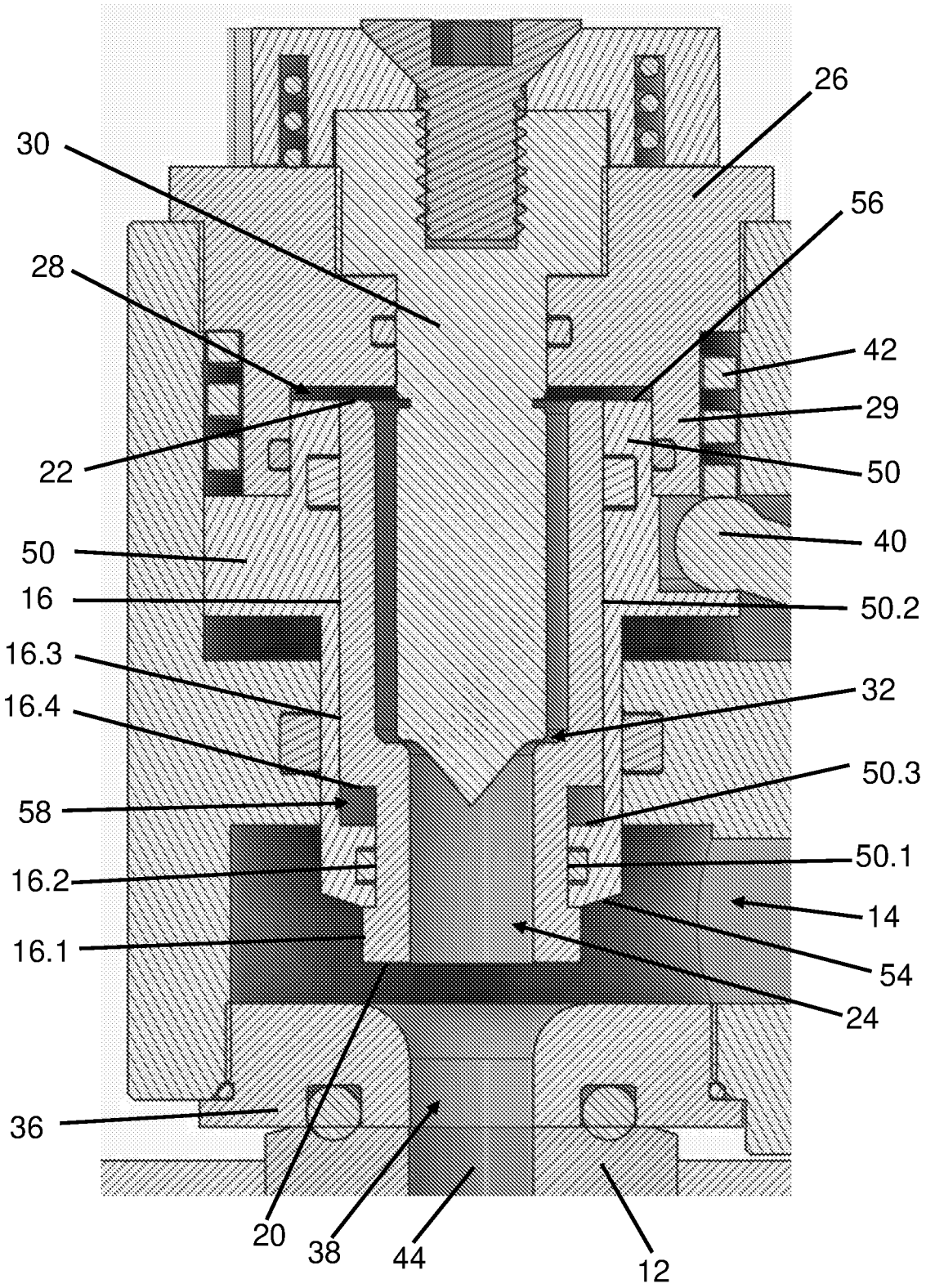
Figure 15:
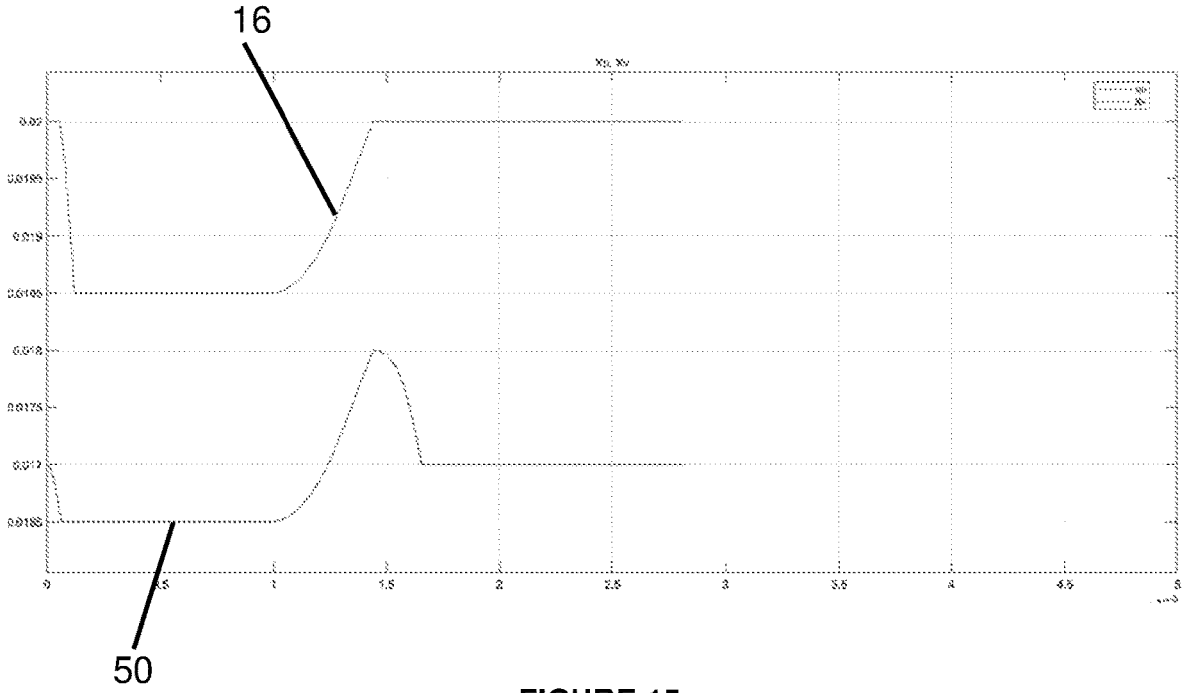
Figure 16:
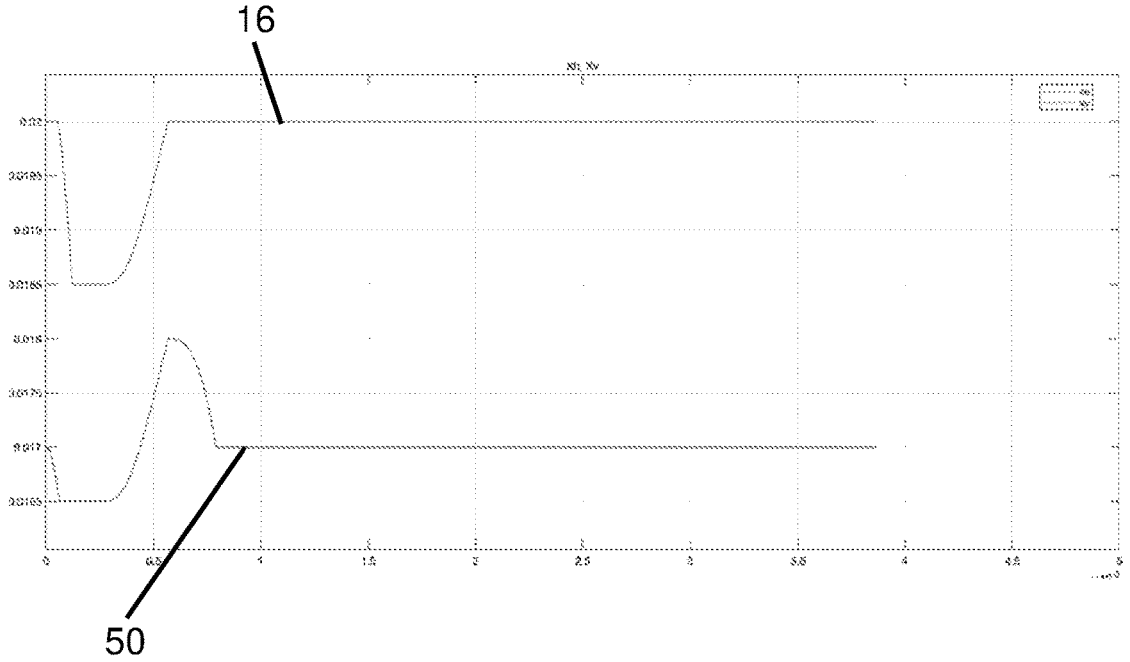
Figure 17:
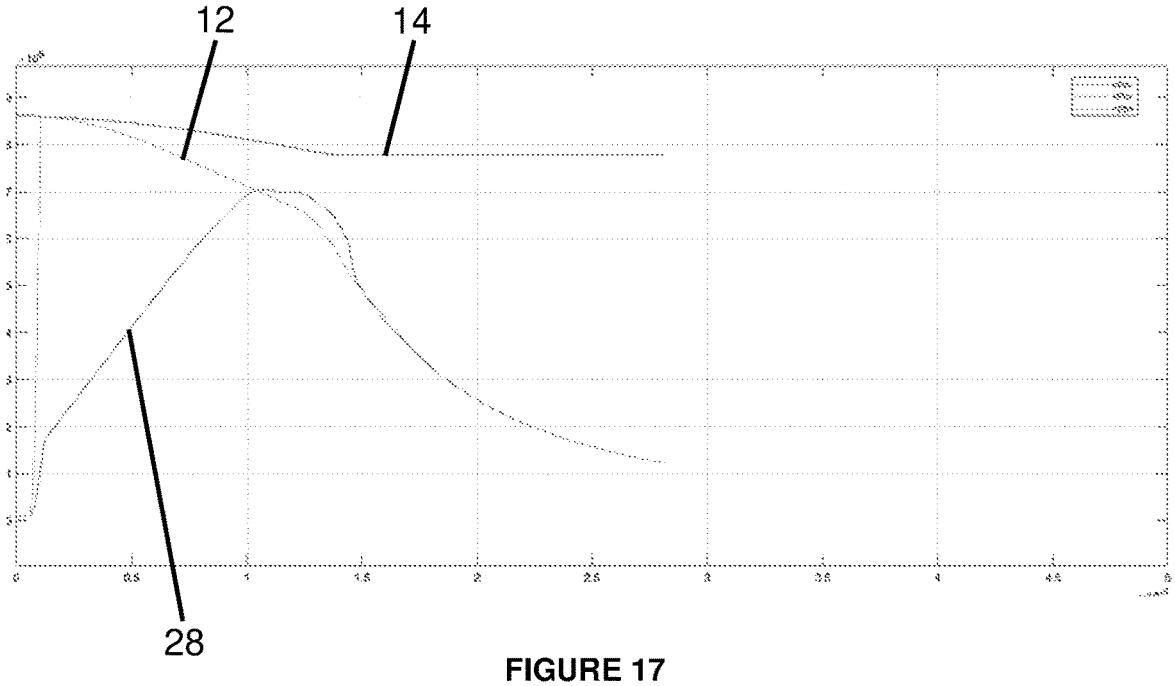
Figure 18:
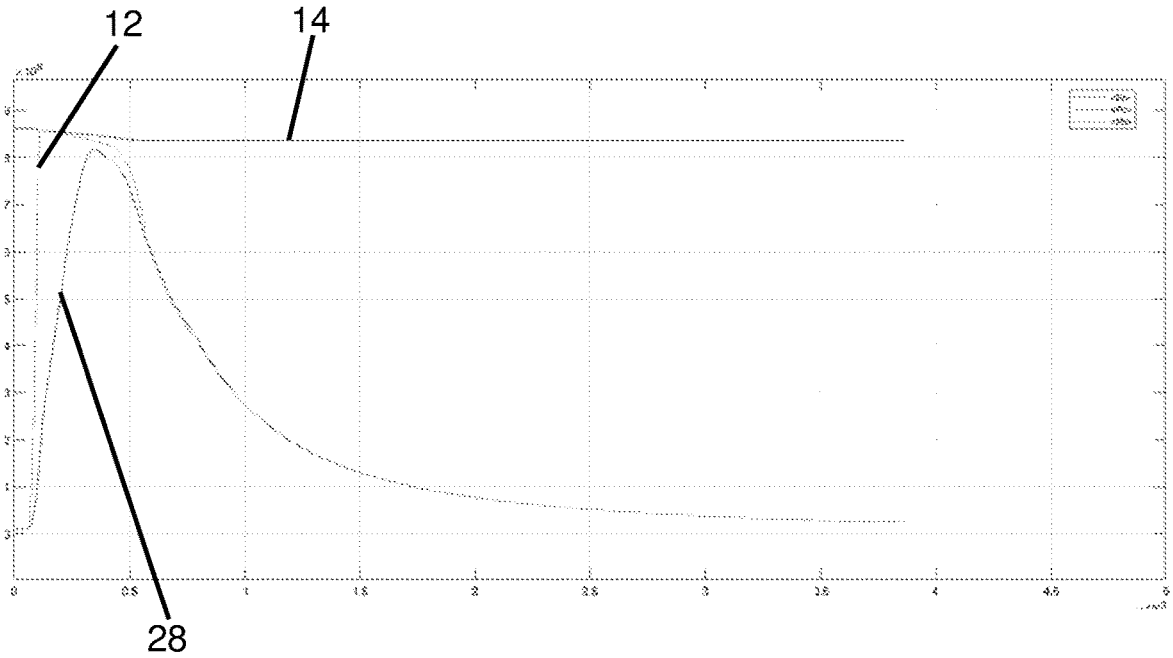
Figure 19:
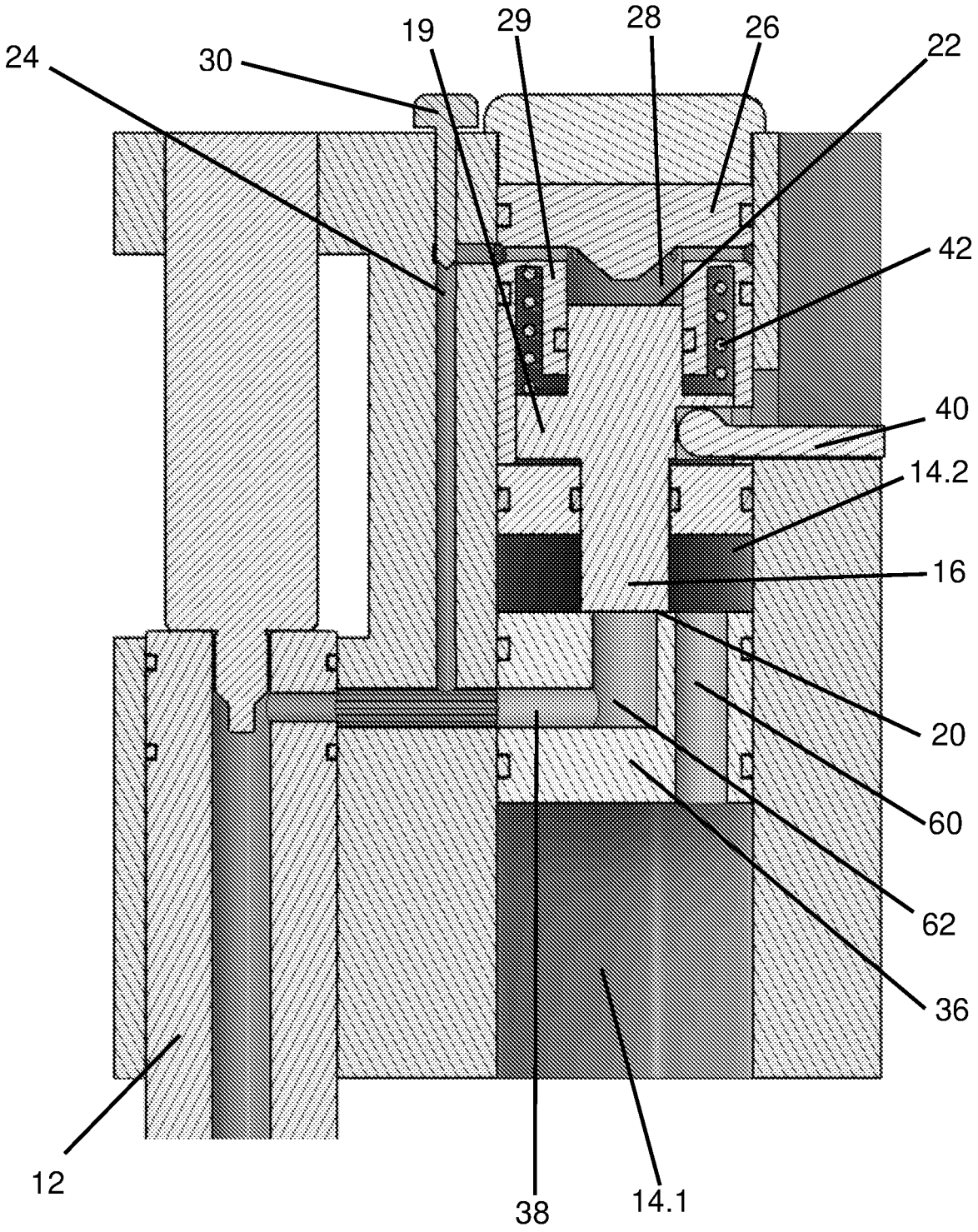
Figure 20:
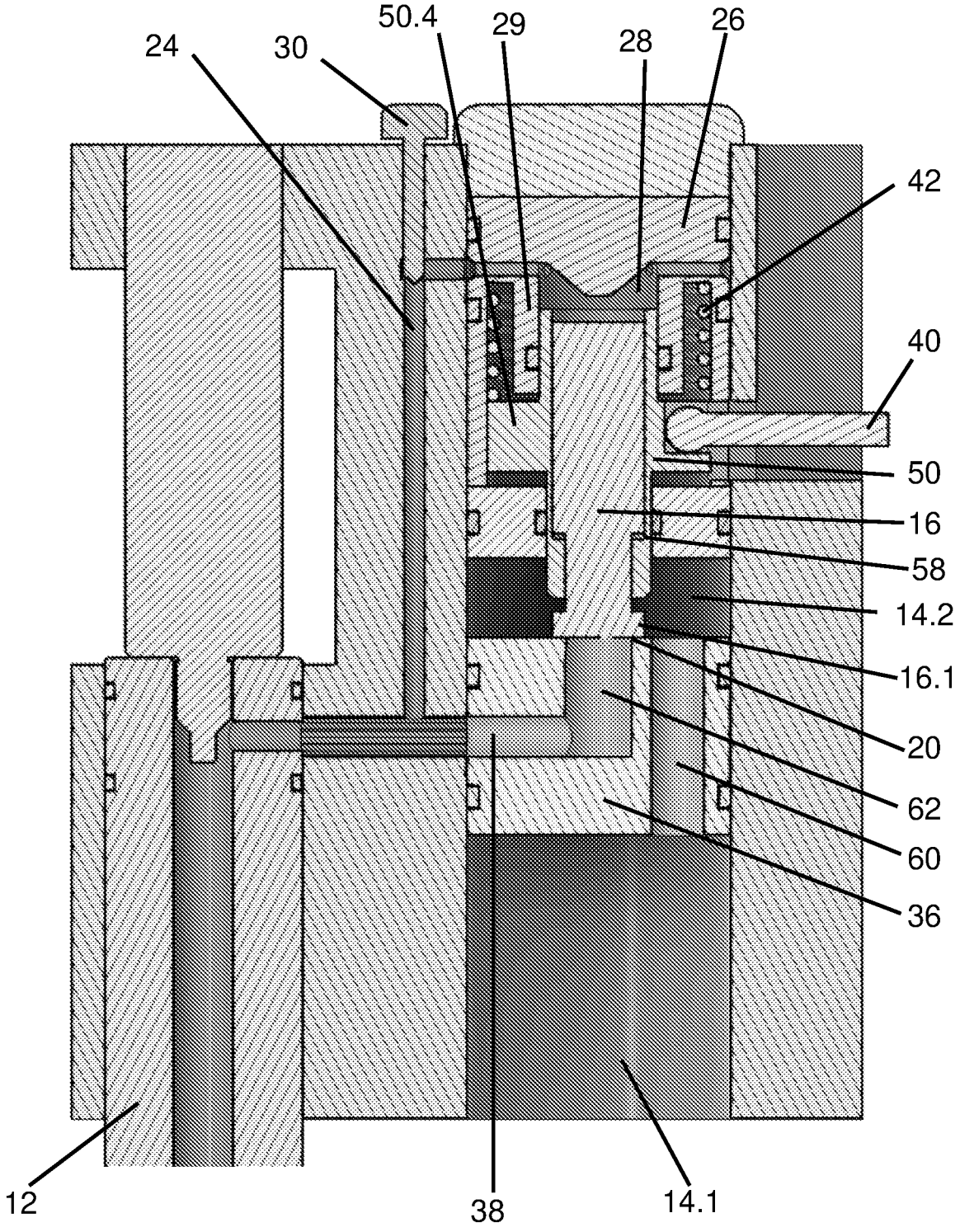

FIG. 1 Prior Art: Basic PCP air gun;

FIG. 2 Prior Art: Poppet valve;

FIG. 3 Prior Art: Poppet valve lift-and-dwell as a function of time;

FIG. 4 Prior Art: Balanced poppet valve;

FIG. 5 Prior Art: Huben valve;

FIG. 6 Prior Art: Huben valve movement as a function of time;

FIG. 7 Sectional view of a valve assembly according to a first embodiment of the invention, with the valve in a closed position;

FIG. 8 Graph illustrating valve lift-and-dwell as a function of time of the first embodiment of the invention, with a small velocity-adjustment gap between the valve and velocity-adjustment screw when the valve is fully open;

FIG. 9 Graph illustrating valve lift-and-dwell as a function of time of the first embodiment of the invention, with a large velocity-adjustment gap between the valve and velocity-adjustment screw when the valve is fully open;

FIG. 10 Graph illustrating evolution of pressure in the plenum, pressure chamber, and barrel during a firing cycle for a small velocity-adjustment gap according to the first embodiment of the invention;

FIG. 11 Graph illustrating evolution of pressure in the plenum, pressure chamber, and barrel during a firing cycle for a large velocity-adjustment gap according to the first embodiment of the invention;

FIG. 12 Sectional view of a valve assembly according to a second embodiment of the invention, with the valve in a closed position;

FIG. 13 Sectional view of a valve assembly according to the second embodiment of the invention, with the valve in an open position and with a large velocity-adjustment gap between the valve and velocity-adjustment screw when the valve is fully open;

FIG. 14 Sectional view of a valve assembly according to the second embodiment of the invention, with the valve in an open position and with a small velocity-adjustment gap between the valve and velocity-adjustment screw when the valve is fully open;

FIG. 15 Graph illustrating sled and valve movement as a function of time according to the second embodiment of the invention, with a small velocity-adjustment gap between the valve and velocity-adjustment screw when the valve is fully open;

FIG. 16 Graph illustrating sled and valve movement as a function of time according to the second embodiment of the invention, with a large velocity-adjustment gap between the valve and velocity-adjustment screw when the valve is fully open;

FIG. 17 Graph illustrating evolution of pressure in the plenum, pressure chamber, and barrel as a function of time for a small velocity-adjustment gap according to the second embodiment of the invention;

FIG. 18 Graph illustrating evolution of pressure in the plenum, pressure chamber, and barrel as a function of time for a large velocity-adjustment gap according to the second embodiment of the invention;

FIG. 19 Sectional view of a valve assembly according to a third embodiment of the invention; and FIG. 20 Sectional view of a valve assembly according to a fourth embodiment of the invention.

FIRST EMBODIMENT: FIGS. 7-11

According to a first embodiment of the invention there is provided a valve assembly [10] suitable for, although not limited to, use in a Pre-Charged Pneumatic (PCP) airgun which includes a barrel [12], a plenum [14], and a trigger mechanism (not shown). The valve assembly [10] comprises a valve [16] including an elongate valve body [18] terminating at one end in a valve face [20] and at an opposite end in valve base [22], with an air flow channel [24] extending through and coaxially aligned with the valve body [18]. The valve [16] also includes a valve wing [19] extending radially outwardly from the valve body [18].

The valve assembly [10] further comprises an end cap [26] which is located at one end of, and coaxially aligned with, the valve [16]. The end cap [26] includes an aperture [27] which protrudes through the end cap [26] and which is co-axially aligned with the air flow channel [24]. The end cap [26] also includes an end cap cylinder [29] extending from one end of the end cap [26] and within which the valve [16] is slidingly displaceable. Displacement of the valve [16] within the end cap cylinder [29] is limited by the valve wing [19] which comes to rest against the end cap cylinder [29] when the valve [16] is fully open. An air pressure chamber [28] is defined between the valve base [22] and the end cap [26], with the air pressure chamber [28] being arranged in air flow communication with the air flow channel [24].

The valve assembly [10] further comprises a velocity-adjustment screw [30] extending through the aperture [27] of the end cap [26], coaxially aligned with the valve [16], and extending partially into the air flow channel [24] to create a velocity-adjustment gap [32] between the valve body [18] and the velocity-adjustment screw [30]. Valve lift is fixed through displacement of the valve body [18], while valve dwell time is controlled by choking airflow into the pressure chamber [28] through adjustment of the velocity-adjustment screw [30].

The valve [16] is displaceable between a closed position, in which it closes air flow from the plenum [14] to the barrel [12]; and an open position in which air flow from the plenum [14] is forced through the barrel [12] to eject a pellet/slug [44]. At the same time air flows from the plenum [14] through the air flow channel [24] and into the pressure chamber [28] to push against the valve base [22], thus forcing the valve [16] to the closed position. The rate of flow of air that enters the pressure chamber [28] is manipulated by the size of the velocity-adjustment gap [32] when the valve [16] is in a fully open position. The size of the velocity-adjustment gap [32] is adjusted by adjusting positioning of the velocity-adjustment screw [30] within the valve body [18].

It will be appreciated that the velocity-adjustment gap [32] decreases when the valve [16] moves from a closed to an open position, thereby decreasing airflow into the pressure chamber [28]; and increases when the valve [16] moves from an open to a closed position, thereby increasing airflow into the pressure chamber [28], resulting in an increased pneumatic force acting on the valve base [22] when the valve is closing.

The valve body [18] includes a stepped internal wall to define a first air flow channel [24.1] of smaller diameter, and a neighbouring, coaxial second air flow channel [24.2] of larger diameter which is arranged in flow communication with the pressure chamber [28], with a substantially rectangular step [34] being defined between the first and second air flow channels [24.1; 24.2]. This configuration slows down flow of air between the valve [16] and the velocity-adjustment screw [30] to reduce the rate of air flow into the pressure chamber [28], hence slowing down pressure rise in the pressure chamber [28]. When the valve [16] is in the open position, the air flow channel [24.1] is positioned within the plenum [14] in an arrangement known as a "Borda Tube". Airflow into the "Borda Tube" is much less efficient than that associated with the air flow into an orifice such as the transfer port [38], further slowing the rate of air flow into the pressure chamber [28].

In the illustrated embodiments of the invention, the valve [16] is coaxially aligned with the barrel [12]. Installation of the valve directly behind a pellet/slug [44] greatly contributes to elimination of gun recoil, especially in larger calibres. This is because forces generated by an accelerating pellet/slug [44] and the valve [16] are opposite to each other and approximately equal. However, it should be understood that the valve [16] may linearly be offset to the barrel [12], such as in prior art installations.

The valve assembly [10] further includes a valve seat [36] located intermediate, and coaxially aligned with, the valve [16] and the barrel [12] against which the valve face [20] seals when the valve [16] is in a closed position. In this embodiment, the valve seat [36] includes a short, large diameter transfer port [38] extending through the valve seat [36]. The transfer port [38] is curved radially outwardly at [39] in a direction towards the valve face [20] to reduce a vena contracta effect when air flows from the plenum [14] into the barrel [12].

The valve assembly [10] includes a trigger-actuated valve lever [40] which mechanically cooperates with the valve [16] for displacing the valve [16] from a closed to an open position. The valve assembly [10] also includes a valve return spring [42] for assisting displacement of the valve [16] from an open to a closed position.

In the first embodiment of the invention, no air pressure from the plenum [14] is exerted on the valve [26] to seal the valve [16] in the closed position. Instead, the valve [16] is sealed in the closed position under pressure only of the valve return spring [42], which is orders of magnitude less than that of air pressure in the plenum [14]. Since the valve return spring [42] is a relatively weak spring, the force required to open the valve [16] is extremely small in comparison to a prior art poppet valve or balanced poppet valve. The valve lever [40] acts directly on the valve [16] to displace the valve [16] from the closed to the open position. In its closed position, both the barrel [12] and pressure chamber [28] are at atmospheric pressure.

A firing cycle starts when the valve lever [40] is moved clockwise by the action of a trigger mechanism, lifting the valve [16] from its seat.

When the valve [16] is lifted from its seat, high pressure air in the plenum [14] acts on the valve face [20] creating a large pneumatic force which moves the valve [16] at extremely high velocity in a direction away from the transfer port [38] (i.e., the valve is blown open). Valve lift is restricted by engagement of the valve wing [19] against the end cap cylinder [29] of the end cap [26]. Impact of the valve [16] with the end cap [26] is cushioned by an impact absorbing washer [46]

between the valve wing [19] and the end cap cylinder [29] to reduce valve bounce.

When the valve [16] is blown open, high-pressure air in the plenum [14] rushes through the transfer port [38] and onto the base of a pellet/slug [44] in the barrel [12], ejecting the pellet/slug [44].

Simultaneously, high pressure air in the plenum [14] rushes through the air flow channel [24.1] and through the velocity-adjustment gap [32] into the pressure chamber [28].

The velocity-adjustment gap [32] between the valve [16] and the velocity-adjustment screw [30] decreases as the valve [16] moves in a direction towards the end cap [26]. When the valve [16] comes to a rest, the area of the velocity-adjustment gap [32] formed between the valve [16] and the velocity-adjustment screw [30] is much smaller than the area of the air flow channel [24], thus restricting the flow rate of air into the pressure chamber [28]. With the valve [16] now completely open, high-pressure air continues to flow into the barrel [12] and through the air flow channel [24] into the pressure chamber [28].

When air pressure in the pressure chamber [28] is nearly equal to that in the plenum [14], the pneumatic force acting on the valve base [22] starts to displace the valve [16] in the direction towards the valve seat [36]. As the valve [16] moves in the direction towards the valve seat [36], the velocity-adjustment gap [32] between the valve [16] and velocity-adjustment screw [30] increases, thus increasing the flow of air into the pressure chamber [28], resulting in an increase in the pneumatic force on the valve base [22]. This force moves the valve [16] very quickly to its closed position against the pneumatic force in the plenum [14].

As the valve [16] closes and contacts the valve seat [36], the valve [16] might bounce, letting short bursts of air into the barrel [12]. Bouncing of the valve [16] will also increase the flow of air into the pressure chamber [28], which will increase the pneumatic force on the valve base [22].

Once the valve [16] closes, air in the pressure chamber [28] flows through the air flow channel [24] into the barrel [12], increasing velocity of the pellet/slug [44] slightly.

Velocity of the pellet/slug [44] can be adjusted by rotating the velocity-adjustment screw [30] either into or out of the air flow channel [24], increasing or decreasing the velocity-adjustment gap [32] between the valve [16] and the velocity-adjustment screw [30] when the valve is fully open. The change in this velocity-adjustment gap [32] increases or decreases the flow of air into the pressure chamber [28], and hence the time required to pressurize the pressure chamber [28] will change, thus increasing or decreasing valve dwell time. Specifically—

(i) the smaller the velocity-adjustment gap [32] between the valve [16] and velocity-adjustment screw [30] when the valve [16] is fully open, the longer the valve dwell time, and hence a more powerful shot will result; whereas (ii) the bigger the velocity-adjustment gap [32] between the valve [16] and velocity-adjustment screw [30] when the valve [16] is fully open, the shorter the valve dwell time, and hence a less powerful shot will result.

The graphs in FIGS. 8 and 9 show the valve lift-and-dwell as a function of time for the two cases [(i) and (ii)] described above (valve bounce on closing was removed from these graphs). The velocity-adjustment screw [30] can be adjusted to any position between its design limits, thus giving a large range of possible pellet/slug [44] velocities. It can also be observed from FIGS. 8 and 9 that valve movement as a function of time approximate a square, indicating that the valve [16] is approaching its theoretical maximum efficiency. The slope of valve return can be increased (made more vertical) by increasing the area of the valve base [22] in relation to the valve face [20]. However, this will reduce the pressure necessary to return the valve [16] to its closed position.

FIG. 10 illustrates evolution of pressure in the plenum [14] (blue line), pressure chamber [28] (red line), and barrel [12] (yellow line) during a firing cycle for a small velocity-adjustment gap [32]. A reduction of airflow into the pressure chamber [28] is clearly visible (change in slope of the red line [28]) when the valve [16] reaches its maximum lift, and the velocity-adjustment gap [32] is at its minimum. The valve [16] is closed after 1.4 mS and air in the pressure chamber [28] flows into the barrel [12]. The pellet/slug [44] leaves the barrel [12] at 2.5 mS after the firing cycle is started.

FIG. 11 illustrates evolution of pressure in the plenum [14] (blue line), pressure chamber [28] (red line), and barrel [12] (yellow line) during a firing cycle for a large velocity-adjustment gap [32]. The flow rate of air into the pressure chamber [28] is much faster (steep slope of the red line [28]) than in the previous case with the velocity-adjustment gap [32] at is maximum when the valve [16] reaches its maximum lift. The valve [16] is closed after 0.55 mS and air in the pressure chamber [28] flows into the barrel [12]. The pellet/slug [44] leaves the barrel [12] at 3.2 mS after the firing cycle is started, indicating a much lower pellet/slug [44] velocity.

In this embodiment of the invention, velocity of the pellet/slug [44] can also be controlled by:

Changing the size of the transfer port [38]—This will limit the volume of air that escapes through the transfer port [38] per unit time for a given plenum [14] pressure. This is commonly used by many air guns in conjunction with adjusting the hammer spring.

Changing pressure in the plenum [14]—The higher the pressure, the more air escapes through the transfer port [38] for a given transfer port size, and vice versa. Changing the plenum pressure is also commonly used to alter the velocity of the pellet/slug [44], although it is more difficult to fine-tune the velocity.

SECOND EMBODIMENT: FIGS. 12-18

This embodiment incorporates much of the same features of the first embodiment and like component parts are indicated by like reference numerals. In the second embodiment of the invention, the valve assembly [10] includes a valve sled [50] within which the valve [16] is arranged coaxially such that the valve [16] is linearly displaceable with, and slightly relative to, the valve sled [50]. The valve sled [50] includes a hollow body [52] terminating at one end in a sled face [54] and at an opposite end in a sled base [56]. The sled body [52] defines a substantially cylindrical, stepped internal wall which creates a sled neck [50.1] of smaller diameter and a sled skirt [50.2] of larger diameter, with a sled step [50.3] being defined between the sled neck [50.1] and sled skirt [50.2]. The valve sled [50] also includes a sled wing [50.4] extending radially outwardly from the sled body [52].

The valve sled [50] is coaxially aligned with the end cap [26] and slidingly displaceable within the end cap cylinder [29]. Displacement of the valve sled [50] within the end cap cylinder [29] is limited by the sled wing [50.4] which comes to rest against the end cap cylinder [29] when the valve [16] is fully open. A pressure chamber [28] is defined between the valve base [22], the sled base [56], and the end cap [26], with the pressure chamber [28] being arranged in air flow communication with the air flow channel [24].

The valve [16] sequentially includes a valve ridge [16.1] of a first diameter, a valve neck [16.2] of a second, smaller diameter, and a valve skirt [16.3] of a third, larger diameter, with a valve step [16.4] being defined between the valve neck [16.2] and valve skirt [16.3]. The valve [16] is located within the valve sled [50] such the sled neck [50.1] slidingly engages the valve neck [16.2]. A small gap [58] is defined between the sled step [50.3] and the valve step [16.4] to allow linear displacement of the valve [16] relative to the valve sled [50].

When the valve [16] is in the closed position (as illustrated in FIG. 12), air pressure from the plenum [14] is exerted on the valve ridge [16.1] to force the valve [16] into the closed position, while simultaneously air pressure from the plenum [14] is exerted on the sled face [54], creating a net force in the direction of the end cap [26], away from the transfer port [38]. However, displacement of the valve sled [50] is restrained by the valve lever [40] acting on the valve sled [50]. The small gap [58] between the valve sled [50] and the valve [16] allows a small, but independent movement between the valve sled [50] and the valve [16] such that the valve [16] cannot open until the valve sled [50] is displaced.

When the valve lever [40] is released by a trigger mechanism, air pressure from the plenum [14] pushes the valve sled [50] in the direction of the end cap [26]. Once the sled step [50.3] engages the valve step [16.4], the valve sled [50] lifts the valve [16] from its seat, pulling the valve open until the sled wing [50.4] comes to rest against the end cap cylinder [29] of end cap [26].

When the valve [16] is lifted from its seat by the valve sled [50], high pressure air in the plenum [14] acts on the valve face [20] creating a large pneumatic force which moves the valve [16] at extremely high velocity in a direction away from the transfer port [38] (i.e., the valve is blown open). Valve lift is restricted by the valve ridge [16.1] coming to rest against the sled face [54]. There might be a small amount of bounce as the valve [16] impacts with the sled face [54], however this bounce will not interfere with the flow of air into the transfer port [38] as the valve [16] linear displacement is greater than % the diameter of the transfer port [38].

When the valve [16] is lifted from its seat by the sled [50], air pressure from the plenum [14] exits the barrel [12] to eject a pellet/slug [44]. Simultaneously air flows from the plenum [14] through the air flow channel [24] into the pressure chamber [28] to push against the valve base [22] and the sled base [56], thus forcing the valve sled [50] and the valve [16] to the closed position. The arrangement is such that the mass flow rate of air that enters the pressure chamber [28] is determined by the size of the velocity-adjustment gap [32] when the valve [16] is in a fully open position. When the plenum [14] is not pressurized, the valve [16] is held in the closed position by the sled face [54] pushing on the valve ridge [16.1] under the action of the return spring [42].

This embodiment provides a self-opening valve [16]: air pressure in the plenum [14] is used to push the valve sled [50] backward and pull the valve [16] along as it moves back, similar to the Huben valve, but with the notable differences that in the valve assembly [10] of the invention, valve lift is fixed and valve dwell is controlled by choking airflow into the pressure chamber [28], which allows for a wide range of pellet/slug [44] velocities for a single pressure setting in the plenum [14] without adjusting the transfer port size or plenum pressure.

Velocity of the pellet/slug [44] can be adjusted by rotating the velocity-adjustment screw [30] to move it either into or out of the air flow channel [24], increasing or decreasing the velocity-adjustment gap [32] that is formed between the valve [16] and the velocity-adjustment screw [30] when the valve [16] is fully open. This change in the velocity-adjustment gap [32] increases or decreases the flow of air into the pressure chamber [28], and hence the time required to pressurize the camber [28] will change, thus increasing or decreasing valve dwell time.

In both the first and second embodiments of the invention, velocity of the pellet/slug [44] is determined by the volume of air being released from the plenum [14], which depends on 3 factors:

- Pressure in the plenum [14]: The higher the pressure in the plenum [14], the more air will be released into the barrel [12] per unit time given for a given transfer port size, and vice versa.
- The area of the transfer port [38]: The bigger the transfer port [38], the more air will be released into the barrel [12] per unit time for a given pressure in the plenum [14], and vice versa.
- Valve dwell time: The smaller the velocity-adjustment gap [32] between the valve [16] and velocity-adjustment screw [30] when the valve [16] is fully open, the longer the valve dwell time, and hence more air will be released into the barrel [12], and vice versa.

It is important to note that for every pellet/slug weight and velocity combination, there exists an ideal balance between the above three factors that will result in maximum efficiency of the airgun. This is especially relevant in big bore airguns where the designer wants to maximize the number of shots for a specific reservoir size.

Referring to the graphs depicted in FIGS. 15 and 16, the valve sled [50] (blue line) and the valve [16] (red line) movement as a function of time is "squarish", indicating that the valve [16] is approaching its theoretical maximum efficiency. The slope of the valve sled [50] and the valve [16] return can be increased (made more vertical) by increasing the area of the sled base [56] and valve base [22] in relation to the valve sled [50] and valve face [20]. However, this will reduce the pressure necessary to return the valve [16] to its closed position. Care needs to be taken that the pressure in the pressure chamber [28] is not lower than the pressure in the barrel [12] when the valve [16] is closed as this will cause a reverse in the direction of the airflow. FIG. 17 illustrates evolution of pressure in the plenum [14], barrel [12], and pressure chamber [28] as a function of time for a small velocity-adjustment gap [32] (such as illustrated in FIG. 14). The reduction of airflow into the pressure chamber [28] is clearly visible (change in slope of the red line [28]) when the valve [16] reaches its maximum lift and the velocity-adjustment gap [32] is at its minimum. The valve [16] is closed after 1.45 mS and air in the pressure chamber [28] flows into the barrel [12]. The pellet/slug [44] leaves the barrel [12] at 2.8 mS after the firing cycle was started.

FIG. 18 illustrates evolution of pressure in the plenum [14], barrel [12], and pressure chamber [28] as a function of time for a large velocity-adjustment gap [32] (such as illustrated in FIG. 13), maintaining the plenum pressure, transfer port size and pellet/slug size the same as in FIG. 17. As can be observed, the flow rate of air into the pressure chamber [28] is much faster (steep slope of the red line [28])

than in the previous case with the velocity-adjustment gap [32] at is maximum when the valve [16] reaches its maximum lift. The valve [16] is closed after 0.57 mS and air in the pressure chamber [28] flows into the barrel [12]. The pellet/slug [44] leaves the barrel [12] at 3.8 mS after the firing cycle is started, indicating a much lower pellet/slug velocity. The valve [16] opens and closes without external energy being applied to it, whether by a spring-and-hammer configuration (as in a traditional air gun), or by pushing it open under the action of a trigger mechanism as in the first embodiment of the invention. The valve [16] can thus be used in any size and power of air gun without affecting its smooth operation.

THIRD EMBODIMENT: FIG. 19

The embodiment illustrated in FIG. 19 contains all the basic elements of the first embodiment of the invention, with the following exceptions:

- The valve assembly is not coaxially aligned with the barrel [12].
- The transfer port [38] is not coaxially aligned with the barrel [12].
- The air flow channel [24] does not protrude through the valve [16].
- The velocity-adjustment screw [30] is not coaxially aligned with the valve [16].

The air flow channel [24] extends between the transfer port [38] and the pressure chamber [28], circumventing the valve [16]. In this embodiment, the valve assembly includes a valve seat [36] which divides the plenum [14] into two plenum compartments [14.1; 14.2]. The valve seat [36] includes a valve seat passage [60] extending through the valve seat [36] for linking the two plenum compartments [14.1; 14.2]. The valve seat [36] also includes a transfer port passage [62] linking one of the plenum compartments [14.2] with the transfer port [38], which also extends out of the valve seat [36]. In this embodiment, the valve [16] is linearly offset to the barrel [12], with the transfer port passage [62] being coaxially aligned with the valve [16] but angled at 90° to the transfer port [38]; while the transfer port [38] is angled at 90° to the barrel [12]. Airflow into the pressure chamber [28] is from the transfer port [38] and not directly from the plenum [14], as in the first embodiment.

The firing sequence is as follows:

- The valve lever [40] is rotated clockwise by the action of a trigger mechanism (not shown). It should be appreciated that the valve [16] can also be pulled in the direction of the end cap [26] with an alternative mechanism, such as a small solenoid.
- The clockwise rotation of the valve lever [40], moves the valve [16] against the force of the valve spring [42] in the direction of the end cap [26], lifting the valve [16] from the valve seat [36].
- When the valve [16] is lifted from the valve seat [36], the high-pressure pneumatic force in the plenum [14] acts against the valve face [20], moving it very quickly in the direction of the end cap [26] until it comes to rest against the end cap [26]. Some bouncing might occur, but this will not affect the flow of air into the transfer port passage [62], since the valve [16] linear displacement is greater than % the diameter of the transfer port passage [62].
- Simultaneously, high pressure air flows through the transfer port passage [62] into the transfer port [38] and into the barrel [12].
- High pressure air also flows from the transfer port [38] into the air flow channel [24] and into the pressure chamber [28] behind the valve [16].
- The flow rate of air into the pressure chamber [28] is controlled by the velocity-adjustment screw [30].
  - The further out the velocity-adjustment screw [30], the faster the air will flow into the pressure chamber [28] and the faster the pressure in the pressure chamber [28] will rise. Accordingly, it takes a shorter period of time to pressurize the pressure chamber [28] and close the valve, resulting in a lesser volume of air being released from the plenum [14] into the transfer port [38] and barrel [12]. This results in a less powerful shot.
  - The closer the velocity-adjustment screw [30], the slower the air will flow into the pressure chamber [28] and the slower the pressure in the pressure chamber [28] will rise. Accordingly, it takes longer to pressurize the pressure chamber [28] and close the valve, resulting in more air being released from the plenum [14] into the transfer port [38] and barrel [12]. This results in a more powerful shot.
- The velocity-adjustment screw [30] can be aligned coaxially with the air flow channel [24] (as shown) or be positioned at right angles to the air flow channel [24].
- As the barrel [12] is pressurized, the pellet/slug [44] is pushed along at very high velocity.
- When the force applied by the rising pressure in the pressure chamber [28] on the valve base [22] is greater than the force applied by the pressure in the plenum [14] on the valve face [20], the valve [16] moves to the closed position, aided by the valve spring [42].
- When the valve [16] contacts the valve seat [36], the valve [16] might bounce releasing further small amounts of air into the transfer port [38].
- With the valve [16] closed, air in the transfer port [38] continues to flow into the barrel [12] and propel the pellet/slug [44] along the barrel [12]. Air also continues to flow into the air flow channel [24] and pressure chamber [28]. This causes pressure in the transfer port [38] to drop.
- When the pressure in the transfer port [38] has dropped below the pressure in the pressure chamber [28], the flow of air in the air flow channel [24] will reverse direction and start flowing from the pressure chamber [28] into the transfer port [38] and into the barrel [12].
- Once the pellet/slug [44] leaves the barrel [12], air in the barrel [12], transfer port [38], air flow channel [24], and pressure chamber [28] is expelled to atmosphere.

This embodiment has all the benefits of the first embodiment, except for being slightly less efficient, as air and hence energy is still available in the transfer port [38], air flow channel [24] and pressure chamber [28] when the pellet/slug [44] leaves the barrel [12].

FOURTH EMBODIMENT: FIG. 20

The air gun valve [16] in this embodiment is self-opening. Air pressure in the plenum [14] is used to push the valve sled [50] backward and pull the valve [16] along as it moves back, much the same as in the second embodiment. Valve dwell is controlled by choking airflow into the pressure chamber [28] behind the valve [16] and valve sled [50]. Choking of the airflow into the pressure chamber [28] allows a wide range of pellet/slug velocities for a single pressure setting in the plenum [14] without adjusting the transfer port [38] size or plenum [14] pressure.

When the valve [16] is closed (as shown in FIG. 20), the valve [16] is pushed against the valve seat [36] by air pressure in the plenum [14.2] acting on the valve ridge [16.1], sealing the plenum [14] from the transfer port [38]. Pressure in the plenum [14] also pushes against the valve sled [50], trying to force it backwards against the valve return spring [42]. However, rearward movement of the valve sled [50] is blocked by the valve lever [40]. The small gap [58] between the valve sled [50] and valve [16] allows a small but independent movement between the valve sled [50] and the valve [16]—the valve [16] cannot open until the valve sled [50] moves backward.

The firing sequence is as follows:

The firing cycle starts when the valve lever [40] is released by a trigger, either mechanical or electrical (solenoid). The pneumatic force acting on the valve sled [50] pushes the valve sled [50] backwards.

As the valve sled [50] moves back, it closes the small gap [58] and impacts with the valve [16]. This impact lifts the valve [16] from the valve seat [36] by a small amount. Backward movement of the valve sled [50] is restricted by the end cap [26].

When the valve [16] is lifted from the valve seat [36], the high-pressure pneumatic force in the plenum [14] acts against the valve face [20], moving it very quickly in the direction of the end cap [26] until it comes to rest against the valve sled [50]. Some bouncing might occur, but this will not affect the flow of air into the transfer port passage [62], as the valve [16] linear displacement is greater than % the diameter of the transfer port passage [62].

Simultaneously, high pressure air flows through the transfer port passage [62] into the transfer port [38] and into the barrel [12].

High pressure air also flows from the transfer port [38] into the air flow channel [24] and into the pressure chamber [28] behind the valve [16] and valve sled [50].

The flow rate of air into the pressure chamber [28] is controlled by the velocity-adjustment screw [30].

The further out the velocity-adjustment screw [30], the faster the air will flow into the pressure chamber [28] and the faster the pressure in the pressure chamber [28] will rise. Consequently, the shorter the time taken to pressurize the pressure chamber [28] and close the valve, resulting in less air being released from the plenum [14], into the transfer port [38] and barrel [12]. A less powerful shot results.

The closer the velocity-adjustment screw [30] the slower the air will flow into the pressure chamber [28] and the slower the pressure in the pressure chamber [28] will rise. Consequently, the longer it takes to pressurize the pressure chamber [28] and close the valve, resulting in more air being released from the plenum [14] into the transfer port [38] and barrel [12]. A more powerful shot results.

The velocity-adjustment screw [30] can be aligned coaxially with the air flow channel [24] (as shown) or be positioned at right angles to it.

As the barrel [12] is pressurized, the pellet/slug [44] is pushed along at very high velocity.

When pressure in the pressure chamber [28] is nearly equal to that in the plenum [14], the pneumatic force acting on the rear of the valve [16] and valve sled [50] starts moving the valve sled [50] to the closed position. The valve sled [50] pushes the valve [16] forward.

As the valve [16] and valve sled [50] impacts the valve seat [36], the valve sled [50], but not the valve [16], will bounce backward and, aided by the pneumatic force on the valve sled [50], continue moving backwards.

When the valve sled [50] reaches its initial position, it will be stopped by the valve lever [40] and trigger mechanism, preventing the valve [16] from opening again.

With the valve [16] now closed, air in the transfer port [38] continues to flow into the barrel [12] and propel the pellet/slug [44] along the barrel [12]. Air also continues to flow into the air flow channel [24] and pressure chamber [28]. This causes pressure in the transfer port [38] to drop.

When the pressure in the transfer port [38] has dropped below the pressure in the pressure chamber [28], the flow of air in the air flow channel [24] will reverse direction and flow from the pressure chamber [28] to the transfer port [38] and into the barrel [12].

Once the pellet/slug [44] leaves the barrel [12], air in the barrel [12], transfer port [38], air flow channel [24] and pressure chamber [28] is expelled to atmosphere.

This assembly has all the benefits of the second embodiment, except for being slightly less efficient, as air and hence energy will still be available in the transfer port [38], air flow channel [24] and pressure chamber [28] when the pellet/slug leaves the barrel [12].

It will be appreciated that alternative embodiments of the invention are possible without departing from the spirit or scope of the invention as set out in the claims.

The invention claimed is:

1. A valve assembly suitable for, although not limited to, use in a Pre-Charged Pneumatic (PCP) airgun which includes a barrel, a plenum, and a trigger mechanism, the valve assembly comprising— a valve including a valve body terminating at one end in a valve face and at an opposite end in a valve base;

an end cap located at one end of the valve such that the valve is slidingly displaceable relative to the end cap;

a pressure chamber defined between the valve base and the end cap;

an air flow channel extending between the plenum and the pressure chamber for guiding pressurized air from the plenum to the valve base; and a velocity-adjustment screw located in the air flow channel for adjusting air flow from the plenum to the pressure chamber;

the assembly being such that valve lift is fixed through displacement of the valve body, while valve dwell time is controlled by choking airflow into the pressure chamber through adjustment of the velocity-adjustment screw.

2. The valve assembly according to claim 1 wherein the valve is displaceable between a closed position, in which it closes air flow from the plenum to the barrel; and an open position in which air flow from the plenum is forced through the barrel to eject a pellet/slug, while simultaneously air flow from the plenum flows through the air flow channel into the pressure chamber to push against the valve base, thus forcing the valve to the closed position, wherein air flow rate into the pressure chamber is manipulated by the velocity-adjustment screw.

3. The valve assembly according to claim 2 wherein the air flow channel extends through and is coaxially aligned with the valve body.

4. The valve assembly according to claim 3 wherein the velocity-adjustment screw extends through the end cap, is coaxially aligned with the valve, and extends partially into the air flow channel to create a velocity-adjustment gap between the valve body and the velocity-adjustment screw.

5. The valve assembly according to claim 4 wherein the size of the velocity-adjustment gap is adjusted by adjusting the velocity-adjustment screw relative to the valve body, the assembly being such that the velocity-adjustment gap decreases when the valve moves from a closed to an open position; and increases when the valve moves from an open to a closed position, thereby increasing airflow into the pressure chamber, resulting in an increased pneumatic force acting on the valve base.

6. The valve assembly according to claim 5 wherein the valve body includes a stepped internal wall which defines a first air flow channel of smaller diameter with an opening that opens into the plenum when the valve is in the open position; and a neighbouring, coaxial second air flow channel of larger diameter with an opening that opens into the pressure chamber, such that the plenum is arranged in air flow communication with the pressure chamber; with a substantially rectangular step being defined between the first and second air flow channels.

7. The valve assembly according to claim 6 wherein the velocity-adjustment screw is positioned within the air flow channel such that the velocity-adjustment gap is defined between an end of the velocity-adjustment screw and the rectangular step in the stepped internal wall of the valve body.

8. The valve assembly according to claim 7 wherein the end cap includes an aperture which protrudes through the end cap in co-axial alignment with the air flow channel through which the velocity-adjustment screw protrudes; and an end cap cylinder extending from one end of the end cap within which the valve is slidingly displaceable.

9. The valve assembly according to claim 8 wherein the valve assembly further includes a valve seat located intermediate, and coaxially aligned with, the valve and the barrel against which the valve face seals when the valve is in a closed position.

10. The valve assembly according to claim 9 wherein the valve seat includes a short, large diameter transfer port extending through the valve seat.

11. The valve assembly according to claim 10 wherein the transfer port is curved radially outwardly towards the direction of the valve face.

12. The valve assembly according to claim 2 wherein the valve is linearly offset to the barrel.

13. The valve assembly according to claim 2 wherein the valve assembly includes a trigger-actuated valve lever which mechanically cooperates with the valve for displacing the valve from a closed position to an open position; and a valve return spring for assisting displacement of the valve from an open position to a closed position.

14. The valve assembly according to claim 2 wherein no air pressure from the plenum is exerted on the valve to seal the valve in the closed position, but instead the valve is sealed in the closed position under pressure only of the valve return spring, which is orders of magnitude less than that of air pressure in the plenum.

15. The valve assembly according to claim 14 wherein the valve lever acts directly on the valve to displace the valve from the closed position to the open position.

16. The valve assembly according to claim 14 wherein the valve includes a valve wing extending radially outwardly from the valve and configured to come to rest against the end cap cylinder of the end cap when the valve is fully open.

17. The valve assembly according to claim 2 wherein the valve assembly includes a valve sled within which the valve is arranged coaxially such that the valve is linearly displaceable with, and slightly relative to, the valve sled.

18. The valve assembly according to claim 17 wherein the valve sled includes a hollow body terminating at one end in a valve sled face and at an opposite end in a valve sled base; and a valve sled wing extending radially outwardly from the hollow body and configured to come to rest against the end cap cylinder of the end cap when the valve is fully open.

19. The valve assembly according to claim 18 wherein the valve sled is coaxially aligned with the end cap and slidingly displaceable, together with the valve, in the end cap cylinder, such that the pressure chamber is defined between the valve sled base, the valve base, and the end cap.

20. The valve assembly according to claim 19 wherein the valve sled body defines a substantially cylindrical, stepped internal wall which creates a valve sled neck of smaller diameter and a valve sled skirt of larger diameter, with a valve sled step being defined between the valve sled neck and valve sled skirt.

21. The valve assembly according to claim 20 which includes a complimentarily configured valve which sequentially includes a valve ridge of a first diameter, a valve neck of a second, smaller diameter, and a valve skirt of a third, larger diameter, with a valve step being defined between the valve neck and valve skirt; the valve being located within the valve sled such that a small gap is defined between the valve sled step and the valve step to allow linear displacement of the valve relatively to the valve sled.

22. The valve assembly according to claim 21 wherein air pressure from the plenum is exerted on the valve ridge to force the valve into the closed position, while simultaneously air pressure from the plenum is exerted on the valve sled face, creating a net force in the direction of the end cap; while the valve lever acts on the valve sled to restrain displacement of the valve sled from the closed to the open position.

23. The valve assembly according to claim 22 wherein once the valve lever is released, air pressure from the plenum pushes the valve sled in the direction of the end cap; once the valve sled step engages the valve step, the valve sled pulls the valve to the open position so that air pressure from the plenum enters the barrel to eject a pellet/slug, while simultaneously air flows from the plenum through the air flow channel into the pressure chamber to push against the valve base and the valve sled base, thus forcing the valve sled and the valve to the closed position, the assembly being such that the mass flow rate of air that enters the pressure chamber is determined by the size of the velocity-adjustment gap when the valve is in a fully open position.

24. The valve assembly according to claim 23 wherein when the plenum is not pressurized, and the valve is held in the closed position by forward pressure from the return spring.

25. The valve assembly according to claim 2 wherein the air flow channel extends between a transfer port and the pressure chamber, circumventing the valve.

26. The valve assembly according to claim 25 wherein the valve assembly includes a valve seat which divides the plenum into two plenum compartments, the valve seat including a valve seat passage extending through the valve seat for linking the two plenum compartments; and a transfer port passage linking one of the plenum compartments with the transfer port.

27. The valve assembly according to claim 26 wherein the valve is linearly offset to the barrel, with the transfer port passage being coaxially aligned with the valve, but angularly offset to the transfer port; and the transfer port being angularly offset to the barrel.

28. The valve assembly according to claim 1 wherein valve linear displacement is greater than ¼ the diameter of the transfer port.

* * * * *